US005646089A

United States Patent [19]

Oshima et al.

[11] Patent Number: 5,646,089

[45] Date of Patent: Jul. 8, 1997

[54] HEAT TRANSFER COVER FILMS

[75] Inventors: Katsuyuki Oshima; Jitsuhiko Ando; Masanori Torii, all of Tokyo, Japan

[73] Assignee: Dai Nippon Insatsu Kabushiki Kaisha, Japan

[21] Appl. No.: 451,971

[22] Filed: May 26, 1995

Related U.S. Application Data

[62] Division of Ser. No. 396,791, Mar. 1, 1995, Pat. No. 5,527,759, which is a division of Ser. No. 22,865, Mar. 1, 1993, Pat. No. 5,427,997, which is a division of Ser. No. 663,952, filed as PCT/JP90/00909, Jul. 13, 1990, abandoned.

[30] Foreign Application Priority Data

| | | | |
|---|---|---|---|
| Jul. 14, 1989 | [JP] | Japan | 1-180472 |
| Jul. 14, 1989 | [JP] | Japan | 1-180473 |
| Jul. 19, 1989 | [JP] | Japan | 1-180471 |
| Sep. 20, 1989 | [JP] | Japan | 1-241929 |
| Dec. 18, 1989 | [JP] | Japan | 1-325870 |
| May 31, 1990 | [JP] | Japan | 2-140011 |

[51] Int. Cl.[6] ..... B41M 5/035; B41M 5/38

[52] U.S. Cl. ..... 503/227; 428/195; 428/423.1; 428/474.4; 428/478.2; 428/480; 428/484; 428/488.4; 428/500; 428/520; 428/532; 428/690; 428/913; 428/914

[58] Field of Search ..... 8/471; 428/195, 428/913, 914, 423.1, 474.4, 478.2, 480, 484, 488.4, 500, 520, 532, 690; 503/227

[56] References Cited

U.S. PATENT DOCUMENTS

| | | | |
|---|---|---|---|
| 3,957,694 | 5/1976 | Bolon et al. | 503/227 |
| 4,218,294 | 8/1980 | Brack | 503/227 |
| 4,484,204 | 11/1984 | Yamamoto et al. | 503/227 |
| 4,522,881 | 6/1985 | Kobayashi et al. | 503/227 |
| 4,545,838 | 10/1985 | Minkus et al. | 503/227 |
| 4,704,310 | 11/1987 | Tighe et al. | 503/227 |
| 5,244,234 | 9/1993 | Oshima et al. | 503/227 |

FOREIGN PATENT DOCUMENTS

| | | | |
|---|---|---|---|
| 2524846 | 10/1983 | France | 503/227 |
| 58-149049 | 9/1983 | Japan | 503/227 |
| 59-85793 | 5/1984 | Japan | 503/227 |
| 59127798 | 7/1984 | Japan | 503/227 |
| 60-064895 | 4/1985 | Japan | 503/227 |
| 60-115025 | 6/1985 | Japan | 503/227 |
| 60-204397 | 10/1985 | Japan | 503/227 |
| 61-162388 | 7/1986 | Japan | 503/227 |
| 1-155478 | 7/1986 | Japan | 503/227 |
| 62-39298 | 2/1987 | Japan | 503/227 |
| 62-214990 | 9/1987 | Japan | 503/227 |
| 62-251190 | 10/1987 | Japan | 503/227 |
| 63-293099 | 11/1988 | Japan | 503/227 |
| 1-58590 | 3/1989 | Japan | 503/227 |
| 1-202492 | 8/1989 | Japan | 503/227 |

*Primary Examiner*—B. Hamilton Hess

*Attorney, Agent, or Firm*—Parkhurst, Wendel & Burr, LLP

[57] ABSTRACT

The present invention relates to a heat transfer cover film characterized in that a specific transparent resin layer (2) is releasably provided on a substrate film (1). This transparent resin layer (2) can be easily laminated on the surface of the resulting image (7Y, 7M and 7C) by heat transfer means, making it possible to provide expeditious provision of image representations which are improved in terms of such properties as durability, gloss and color development and is curl-free.

1 Claim, 1 Drawing Sheet

HEAT TRANSFER COVER FILMS

This is a Division of application Ser. No. 08/396,791 filed Mar. 1, 1995, now U.S. Pat. No. 5,527,759, which in turn is a Rule 60 divisional application Ser. No. of 08/022,865 filed Mar. 1, 1993, now U.S. Pat. No. 5,427,997, which in turn is a Rule 62 divisional application of Ser. No. 07/663,952 filed as PCT/JP90/00909, Jul. 13, 1990, now abandoned.

TECHNICAL FIELD

The present invention relates to a heat transfer cover film. More particularly, the present invention relates to a heat transfer cover film enabling heat transferred images to be improved in terms of such durability as rub resistance and allowing them to develop color and luster so well. The present invention also concerns a heat transfer process making use of such cover films.

BACKGROUND TECHNIQUE

So far, heat transfer techniques have been widely used for simple and expeditious printing. Allowing various images to be produced expeditiously, these heat transfer techniques have incidentally been employed for prints usually made in a small number, e.g. for preparing ID or other cards.

Where it is desired to obtain color images like photographs of face, another type of heat transfer technique is now available, making use of heat transfer films of continuous length comprising a continuous substrate film on which a number of heat transfer layers colored in yellow, magenta and cyan (and black, if necessary) are formed successively and repeatedly.

Such heat transfer sheets are generally broken down into two types, one referred to as a so-called wax type of heat transfer film in which a heat transfer layer is thermally softened and transferred onto an image-receiving material in an imagewise manner and the other a so-called sublimation type of heat transfer film in which only a dye sublimes (migrates) thermally from within a heat transfer layer onto an image receiving sheet after an imagewise pattern.

When ID or other cards are to be produced with such heat transfer films as mentioned above, the wax type of heat transfer film has the advantage of being capable of forming verbal, numerical or other images, but involves the disadvantage that such images are poor in durability, esp., rub resistance.

With the sublimation type of heat transfer film, on the other hand, it is possible to obtain gray scale images, i.e., gradation pattern, like photographs of face. Unlike those obtained with ordinary ink, however, the formed images are less lustrous for lack of any vehicle and, by the same token, are poor in durability, e.g. rub resistance.

In order to solve such problems, it has been proposed so far to laminate transparent films on the surfaces of the images. However, this is not only cumbersome to handle but gives rise to card curling as well, because the cards are laminated all over the surfaces. What is more, too thin films cannot be used in view of lamination work, thus posing a problem that the overall thickness of cards increase.

As an alternative to the above-mentioned lamination technique, it has been proposed to coat the surfaces of images with heat- or ionizing radiation-curable resins and cure them. However, this is not only troublesome to handle but also brings about a possibility that the images may be attacked by solvents in coating materials. With the heat-curable resins, there is another possibility that the dyed images may discolor or fade due to the heat used for curing.

It is therefore an object of this invention to provide a heat transfer cover film which can solve the above-mentioned problems of the prior art and so can expeditiously give excellent, curl-free images that are improved in terms of such properties as durability, esp. rub resistance, luster, color development. Another object is to provide a heat transfer process making use of such a cover film.

DISCLOSURE OF THE INVENTION

The above-mentioned and other objects and features of the invention are achievable by the following aspects of the invention.

The first aspect of this invention concerns a heat transfer cover film characterized in that an ionizing radiation-cured resin layer is releasably formed on a substrate film.

By forming an ionizing radiation-cured resin layer on a substrate film in a releasable manner and transferring that layer onto the surface of a transfer image, it is possible to provide expeditious production of an excellent, curl-free image representation which is improved in terms of such properties as durability, esp. rub resistance, gloss and color development.

In a particularly preferable embodiment, a relatively large amount of transparent particles may be incorporated in the ionizing radiation-cured resin layer, whereby a protective layer having a much more improved rub resistance is heat transferable, because the film can be well cut during heat transfer.

The second aspect of this invention concerns a heat transfer cover film characterized in that a wax-containing transparent resin layer is releasably formed on a substrate film.

By forming a wax-containing resin layer on a substrate film in a releasable manner and transferring it onto the surface of a transfer image, it is possible to provide expeditious production of an excellent, curl-free image representation which is improved in terms of such properties as durability, esp. rub resistance, gloss and color development, since that layer can be easily transferred onto the image by the heat heat used for printing.

The third aspect of this invention concerns a heat transfer cover film characterized in that a silicone-modified transparent resin layer is releasably formed on a substrate film.

By forming a silicone-modified transparent resin layer on a substrate film in a releasable manner and transferring it onto the surface of a transfer image, it is possible to provide expeditious production of an image representation which is improved in terms of such properties as durability, esp. rub resistance, chemical resistance and solvent resistance, since the transparent resin layer is easily transferable onto the image by the heat used for printing.

The fourth aspect of this invention concerns a heat transfer cover film including a substrate film having a transparent resin layer releasably formed thereon, said resin layer being further provided on its surface with a heat-sensitive adhesive layer, characterized in that said heat-sensitive adhesive layer is made of a resin having a glass transition temperature or Tg lying between 40° C. and 75° C.

By constructing from a resin with a Tg of 40°–75° C. a heat-sensitive adhesive layer provided on the surface of a transparent resin layer, the transparent resin layer can be well transferred onto an image through a thermal head while it is kept in good "foil cutting" condition. Thus the transparent resin layer is so easily transferred on the image by the heat of the thermal head that an image representation improved in terms of such properties as durability, esp. rub resistance, chemical resistance and solvent resistance can be obtained expeditiously.

The fifth aspect of this invention concerns a heat transfer process in which (a) a dye layer of a heat transfer sheet including a substrate film having said dye layer on its surface is overlaid on (b) a dye-receiving layer of a heat transfer image-receiving sheet including a substrate film having said dye-receiving layer on its surface in opposite relation; heat is applied from the back surface of said heat transfer sheet according to an imagewise pattern to form an image; and a transparent protective film is laminated on the surface of said image, characterized in that said dye layer contains a releasant, while said dye-receiving layer is releasant-free or contains a releasant in such an amount as to offer no impediment to the lamination of said transparent protective layer.

By allowing the dye layer to contain the releasant in an amount sufficient to ensure easy release of it from the dye-receiving layer during heat transfer while permitting the dye-receiving layer to be releasant-free or contain the releasant in such an amount as to offer no impediment to the lamination of the transparent protective layer, it is possible to laminate the transparent protective layer easily on the surface of the image formed by heat transfer and thereby produce an image representation which is improved in terms of such properties as durability, esp. rub resistance, resistance to staining, light fastness, resistance to discoloration and fading in the dark and storability.

It is a further object of this invention to provide a heat transfer sheet enabling an image having an improved gray scale to be easily produced simultaneously with high-density verbal, numerical or other images. This object is achievable by the following aspect of the invention.

The sixth aspect of this invention concerns a heat transfer sheet in which a substrate sheet is provided on the same surface with a first heat transfer layer comprising a thermally migratable dye and an untransferable binder and a second heat transfer layer comprising a dyed or pigmented, heat-meltable binder, characterized in that said substrate sheet is made of a polyester film treated on at least its surface to be provided with said heat transfer layers in such a way that said surface is made easily bondable.

By using as a substrate sheet a polyester film made readily bondable to heat transfer layers, it is possible to provide a heat transfer sheet enabling a clear gray scale image and a clear verbal or other image to be made at the same time.

Such a heat transfer sheet as described above is especially useful for forming the images required to have a cover film. For that purpose, this heat transfer sheet may also have a transparent layer for such a cover film as mentioned just above.

BEST MODES FOR CARRYING OUT THE INVENTION

First Aspect of the Invention

The first aspect of this invention will now be explained more illustratively with reference to the drawings attached hereto to illustrate the preferred embodiments diagrammatically.

Figure 1:
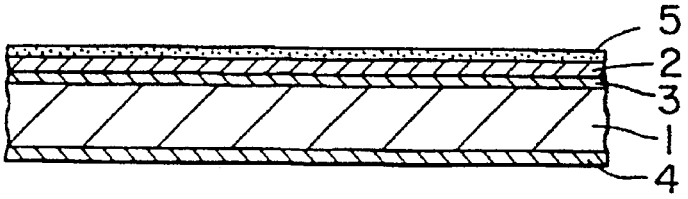
FIGS. 1 and 3 each are a sectional view of the heat transfer cover film according to one embodiment of this invention, FIGS. 2 and 4 each are a sectional view of how a transparent resin layer has been formed on a heat transfer image with the heat transfer cover film.

Referring now to FIG. 1, there is diagrammatically shown a section of the heat transfer cover film according to one preferable embodiment of this invention, wherein an ionizing-radiation-cured resin layer 2 is releasably formed on a substrate film 1.

A release layer, shown at 3 in FIG. 1, is provided to decrease the adhesion between the resin layer 2 and the substrate film 1, thereby making release of that layer 2 easy. This layer 3 may be unnecessary when the film 1 is well releasable from the resin layer 2. A back layer, shown at 4, is provided to prevent a printer's thermal head from sticking to the film 1. This layer 4 may again be dispensed with when the properties of the film 1 such as heat resistance and slip properties are satisfactory.

The heat transfer cover film of this invention will now be explained in greater detail with reference to what it is made of and how to produce it.

No particular limitation is imposed upon the material of which the substrate film 1 is made. Any material so far available for conventional heat transfer films may be used as such to this end. Other materials may, of course, be employed.

Illustrative examples of the material of which the substrate film 1 is made include tissues such as glassine paper, condenser paper and paraffin paper. Besides, use may be made of plastics such as polyester, polypropylene, cellophane, polycarbonate, cellulose acetate, polyethylene, polyvinyl chloride, polystyrene, nylon, polyimide, polyvinylidene chloride, and ionomer or their composite materials with said papers.

The substrate film 1 may vary in thickness to have proper strength, heat resistance, etc., but should preferably have a thickness ranging generally from 3 μm to 100 μm.

In this invention, the ionizing radiation-cured resin layer 2 is formed of an ionizing radiation-curable resin. Ionizing radiation-curable resins so far known in the art may be used, if they are polymers or oligomers having a radically polymerizable double bond in their structure, e.g. those comprising (meth)acrylates such as polyester, polyether, acrylic resin, epoxy resin and urethane resin, all having a relatively low molecular weight, and radically polymerizable monomers or polyfunctional monomers optionally together with photopolymerization initiators, and capable of being polymerized and crosslinked by exposure to electron beams or ultraviolet rays.

The radically polymerizable monomers, for instance, may include (meth)acrylic ester, (meth)acrylamide, allyl compounds, vinyl ethers, vinyl esters, vinyl cyclic compounds, N-vinyl compounds, styrene, (meth)acrylic acid, crotonic acid and itaconic acid. The polyfunctional monomers, for instance, subsume diethylene glycol di(meth) acrylate, triethylene glycol di(meth)acrylate, tetraethylene glycol di(meth)acrylate, trimethylolpropane tri(meth) acrylate, pentaerythritol tetra(meth)acrylate, dipentaerythritol hexa(meth)acrylate, tris-(β-(meth)acryloxyethyl) isocyanurate.

In the 1st aspect of this invention, suitable solvents, non-reactive transparent resins or the like, if required, may be added to the ionizing radiation-curable resin comprising the above-mentioned components to prepare ink whose viscosity, etc. are regulated. This ink is then coated on the substrate film by numerous means such as gravure coating, gravure reverse coating or roll coating. Subsequent drying and curing gives the ionizing radiation-cured resin layer 2, which has preferably a thickness of about 0.5 μm to about 20 μm.

Radiations such as ultraviolet rays or electron beams are used for curing the ionizing radiation-curable resin layer. For irradiation, all conventional techniques may be used as such. For electron beam curing as an example, use may be made of electron beams having an energy of 50 to 1,000 KeV, preferably 100 to 300 KeV, emitted from various electron beam accelerators such as those of Cockroft-Walton type, van de Graaff type, resonance transformation, insulating core transformer, linear, electrocurtain, dynamitoron and high-frequency types, and so on. For ultraviolet curing, use may be made of ultraviolet rays emanating from such light sources as ultra-high pressure mercury lamps, low pressure mercury lamps, carbon arcs, xenon arcs or metal halide lamps. It is understood that curing by ionizing radiations may be carried out just after the formation of the curable layer or after the formation of all the layers.

When forming the aforesaid ionizing radiation-cured resin layer, it is desired that a relatively large amount of particles of high transparency be added to said cured resin layer. These particles may embrace such inorganic particles as silica, alumina, calcium carbonate, talc or clay particles or such organic particles such as acrylic, polyester, melamine or epoxy resin particles, all being divided to as fine as submicrons or a few μm. Preferably, such particles of high transparency are used in an amount ranging from 10 to 200 parts by weight per 100 parts by weight of the ionizing radiation-curable resin. In too small amounts insufficient "film cutting" can take place during heat transfer, whereas in too large amounts the protective layer is lacking in transparency. Various images to be covered may be further improved in terms of such properties as slip properties, gloss, light fastness, weather resistance and whiteness by incorporation of other additives, e.g. waxes, slip agents, UV absorbers, antioxidants and/or fluorescent brighteners.

Prior to forming the ionizing radiation-cured resin layer, it is preferred to provide the release layer 3 on the surface of the substrate film. Such a release layer is made of such releasants as waxes, silicone wax, silicone resin, fluorocarbon resin and acrylic resin. The release layer 3 may be formed in similar manners as applied for forming the aforesaid ionizing radiation-cured resin layer, except curing. When it is desired to obtain a matted protective layer after transfer, various particles may be incorporated in the release layer. Alternatively, use may be made of a substrate film matted on its surface on which the release layer is to be provided.

When the heat transfer film used in this invention is particularly made of a polyester film made easily bondable, a water soluble polymer is used as the release layer. As such a water soluble polymer, use is preferably made of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic and water soluble polyamide, which may be used in combination of two or more to control releasability. The release layer may then have a thickness of about 0.01 μm to about 5 μm.

In order to make these layers more transferable, a heat-sensitive adhesive layer 5 may be additionally provided on the surface of the ionizing radiation-cured resin layer. Such an adhesive layer, for instance, may be formed by coating on that surface resins of improved hot adhesiveness such as acrylic resin, vinyl chloride resin, vinyl chloride/vinyl acetate copolymer resin and polyester resin, followed by drying, and may preferably have a thickness of about 0.5 μm to about 10 μm.

While the heat transfer cover film of the 1st aspect of this invention is constructed as mentioned above, it is understood that the ionizing radiation-cured resin may be provided on the substrate film independently or successively in combination with a sublimation type of dye layer and a wax ink layer.

Preferably, such a heat transfer cover film as mentioned above is used specifically, but not exclusively, to protect images obtained with the transfer and/or wax types of heat transfer techniques. Especially when applied to sublimation transfer images, it does not only provide a protective layer for said images but makes them clearer as well, because the dyes forming them are again allowed to develop color due to the heat at the time of heat transfer.

It is also noted that the sublimation and/or wax types of transfer images may have been formed on any one of image-receiving materials heretofore known in the art. However, images formed on card materials made of polyester resin, vinyl chloride resin, etc. is preferable in the 1st aspect of this invention. Such card materials may be provided with embossments, signatures, IC memories, magnetic layers or other prints. Alternatively, they may be provided with embossments, signatures, magnetic layers, etc. after the heat transfer of the cover film.

Figure 2:
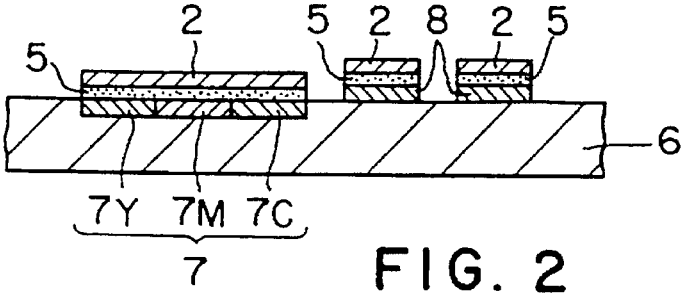

How to produce a card with the heat transfer cover film according to the 1st aspect of this invention will now be explained illustratively with reference to FIG. 2.

First, an yellow dye layer of a sublimation type of heat transfer sheet is overlaid on the surface of a card material 6 to transfer an yellow image 7Y thereonto with a thermal printer operating according to chromatic separation signals. Likewise, magenta and cyan images 7M and 7C are transferred onto the same region to produce a desired color image 7. Then, characters, signs and the like, shown at 8, are printed as desired, with a wax ink type of heat transfer sheet. Subsequently, the ionizing radiation-cured resin layer is transferred onto the color image 7 and/or verbal image 8 to form a protective film 2, using the heat transfer cover film of this invention. In this manner, a desired card is obtained.

The thermal printer used for the aforesaid heat transfer may be independently (or, preferably, continuously) accommodated to sublimation transfer, wax ink transfer and heat transfer covering. Alternatively, these transfer operations may be performed at properly regulated energy levels with a common printer. It is noted that as the heating means suitable for this invention, not only are thermal printers applicable but hot plates, hot rolls, irons or other units are also usable.

According to the 1st aspect of this invention wherein a substrate film is releasably provided thereon with an ionizing radiation-cured resin layer, which is in turn transferred onto the surface of a transfer image, it is possible to provide expeditious production of an excellent, curl-free image representation which is improved in terms of such properties as durability, esp. rub resistance, gloss and color development.

In a particularly preferred embodiment, a protective layer having a much more improved rub resistance can be transferred onto a transfer image by incorporating a relatively large amount of transparent particles in the ionizing radiation-cured resin layer, because the "film cutting" at the time of transfer takes place so well.

Second Aspect

In the cover film according to the 2nd aspect of this invention, a wax-containing transparent resin layer 2 is releasably provided on a substrate film 1.

It is noted that reference numeral 3 stands for a release layer provided to reduce the adhesion between the resin layer 2 and the substrate film 1, thereby making release of that layer 2 easy. This layer 3 may be unnecessary when the film 1 is well releasable from the resin layer 2.

A back layer, shown at 4, is provided to prevent a printer's thermal head from sticking to the film 1. This layer 4 may again be dispensed with when the properties of the film 1 such as heat resistance and slip properties are satisfactory.

The heat transfer cover film of the 1st aspect of this invention will now be explained in greater detail with reference to what it is made of and how to produce it.

No particular limitation is imposed upon the material of which the substrate film 1 is made. Any material so far available for conventional heat transfer films may be used as such to this end. Other materials may, of course, be employed.

Illustrative examples of the material of which the substrate film 1 is made include tissues such as glassine paper, condenser paper and paraffin paper. Besides, use may be made of plastics such as polyester, polypropylene, cellophane, polycarbonate, cellulose acetate, polyethylene, polyvinyl chloride, polystyrene, nylon, polyimide, polyvinylidene chloride and ionomer or their composite materials with said papers.

The substrate film 1 may vary in thickness to have proper strength, heat resistance, etc., but should preferably have a thickness ranging generally from 3 μm to 100 μm.

The transparent resin layer 2 provided on the substrate film comprises a mixture of transparent resin with wax.

The transparent resins used, for instance, may include polyester resin, polystyrene resin, acrylic resin, epoxy resin, cellulose resin, polyvinyl acetal resin and vinyl chloride/vinyl acetate copolymer resin. These resins excel in transparency but tend to form films so relatively tough that they cannot be well cut at the time of transfer. Also, they are so less than satisfactory in slip properties that they are likely to be injured by surface rubbing, thus decreasing in surface gloss. According to the 2nd aspect of this invention, such transparent resins are improved in terms of the "film cutting" at the time of transfer and slip properties by mixing them with wax.

Typical examples of the wax used in the 2nd aspect of this invention are microcrystalline wax, carnauba wax and paraffin wax. Besides, use may made of various types of wax such as Fischer-Tropsch wax, various low-molecular-weight polyethylenes, Japan wax, beeswax, spermaceti, ibotawax, wool wax, shellac wax, candelila wax, petrolactam, partially modified wax, fatty acid ester and fatty acid amide.

Preferably, the wax should be used in the range of 0.5 to 20 parts by weight per 100 parts by weight of the transparent resin. In too small amounts the wax makes the "film cutting" at the time of transfer and the rub resistance of the transferred film insufficient, whereas in too large amounts the wax makes the durability and transparency of the transferred film unsatisfactory.

The transparent resin and wax may be admixed together specifically, but not exclusively, by hot melt mixing or mixing them in an organic solvent in which they can be dissolved.

Most preferably, the transparent resin is used in the form of a dispersion (or emulsion), while the wax is employed in the form of a solution or dispersion (emulsion). Then, they are mixed together. After the resulting dispersion (emulsion) has been coated on the substrate film, drying is carried out at a relatively low temperature such that at least a part of the resin particles remains, thereby preparing a coat. The thus formed coat has a rough surface due to containing some particles and is partly clouded. However, that coat is smoothened on the surface by the heat and pressure applied at the time of heat transfer, so that it can be transferred onto the surface of a transfer image in the form of a smooth, transparent film.

The transparent resin layer 2 may be formed on the substrate film 1 or the release layer 3 which has been formed on it by coating thereon an ink preparation comprising the above-mentioned resin and wax by numerous means such as gravure coating, gravure reverse coating or roll coating, followed by drying. If the transparent resin layer is made of a mixed resin/wax dispersion, then it is preferable to carry out drying at a temperature lower than the melting point of the resin particles, e.g. a relatively low temperature lying in the range of about 50° C. to about 100° C. Because drying at such a temperature gives a coat containing some resin particles, the "film cutting" at the time of heat transfer is improved so significantly that the slip properties of the transfer film can be retained.

When forming the aforesaid transparent resin layer, various images to be covered may be improved in terms of such properties as gloss, light fastness, weather resistance and whiteness by incorporating in it such additives as slip agents, UV absorbers, antioxidants and/or fluorescent brighteners.

Prior to forming the aforesaid transparent resin layer, it is preferred to provide the release layer 3 on the surface of the substrate film. Such a release layer is made of such releasants as waxes, silicone wax, silicone resin, fluorocarbon resin and acrylic resin. The release layer 3 may be formed in similar manners as applied for forming the transparent resin layer, and may have a thickness of about 0.5 μm to about 5 μm. When it is desired to obtain a matted protective layer after transfer, various particles may be incorporated in the release layer. Alternatively, use may be made of a substrate film matted on its surface on which the release layer is to be provided.

When the heat transfer film used in this invention is particularly made of a polyester film rendered easily bondable, a water soluble polymer is used as the release layer. As such a water soluble polymer, use is preferably made of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic and water soluble polyamide, which may be used in combination of two or more to control releasability. The release layer may then have a thickness of about 0.01 μm to about 5 μm.

In order to make these layers more transferable, a heat-sensitive adhesive layer 5 may be additionally provided on the surface of the transparent resin layer. Such an adhesive layer, for instance, may be formed by coating on that surface resins of improved hot adhesiveness such as acrylic resin, vinyl chloride resin, vinyl chloride/vinyl acetate copolymer resin and polyester resin, followed by drying, and may have a thickness of about 0.5 μm to about 10 μm.

While the heat transfer cover film of the 2nd aspect of this invention is constructed as mentioned above, it is understood that the transparent resin layer may be provided on the substrate film independently or successively in combination with a sublimation type of dye layer and a wax ink layer.

Preferably, such a heat transfer cover film as mentioned above is used specifically, but not exclusively, to protect images obtained with the sublimation and/or wax types of heat transfer techniques. Especially when applied to sublimation transfer images, it does not only provide a protective layer for said images but makes them clearer as well, because the dyes forming them are again allowed to develop color due to the heat at the time of heat transfer.

It is also noted that the sublimation and/or wax types of transfer images may have been formed on any one of image-receiving materials heretofore known in the art. However, images formed on card materials made of polyester resin, vinyl chloride resin, etc. is preferable in the 2nd aspect of this invention. Such card materials may be provided with embossments, signatures, IC memories, magnetic layers or other prints. Alternatively, they may be provided with embossments, signatures, magnetic layers, etc. after the heat transfer of the cover film.

How to produce a card with the heat transfer cover film according to the 2nd aspect of this invention will now be explained illustratively with reference to FIG. 2.

First, an yellow dye layer of a sublimation type of heat transfer sheet is overlaid on the surface of a card material 6 to transfer an yellow image 7Y thereonto with a thermal printer operating according to chromatic separation signals. Likewise, magenta and cyan images 7M and 7C are transferred onto the same region to produce a desired color image 7. Then, characters, signs and the like, shown at 8, are printed as desired, with a wax ink type of heat transfer sheet. Subsequently, the transparent resin layer is transferred onto the color image 7 and/or verbal image 8 to form a protective film 2, using the heat transfer cover film of this invention. In this manner, a desired card is obtained.

The thermal printer used for the above-mentioned heat transfer may be independently (or, preferably, continuously) accommodated to sublimation transfer, wax ink transfer and heat transfer covering. Alternatively, these transfer operations may be performed at properly regulated energy levels with a common printer. It is noted that as the heating means suitable for this invention, not only are thermal printers applicable but hot plates, hot rolls, irons or other units are also usable.

According to the 2nd aspect of this invention wherein a substrate film is releasably provided thereon with a wax-containing transparent resin layer, which can then be easily transferred onto an image due to the heat at the time of printing, it is possible to provide expeditious production of an excellent, curl-free image representation which is improved in terms of such properties as durability, esp. rub resistance, gloss and color development.

Third Aspect

In the heat transfer cover film according to the 3rd aspect of this invention, a silicone-modified transparent resin layer 2 is releasably formed on a substrate film 1.

It is noted that reference numeral 3 stands for a release layer provided to decrease the adhesion between the transparent resin layer and the substrate film, making the transfer of the transparent resin film easy. This layer 3 may be dispensed with when the transparent resin layer is well releasable from the substrate film.

A back layer 4 is provided to prevent a printer's thermal head from sticking to the substrate film. This layer 4 may again be omitted when the properties of the substrate film such as heat resistance and slip properties are satisfactory.

The heat transfer cover film according to the 3rd aspect of this invention will now be explained in greater detail with reference to what it is made of and how to form it.

No particular limitation is imposed upon the material of which the substrate film 1 is made. Any material so far available for conventional heat transfer films may be used as such to this end. Other materials may, of course, be employed.

Illustrative examples of the material of which the substrate film 1 is made include tissues such as glassine paper, condenser paper and paraffin paper. Besides, use may be made of plastics such as polyester, polypropylene, cellophane, polycarbonate, cellulose acetate, polyethylene, polyvinyl chloride, polystyrene, nylon, polyimide, polyvinylidene chloride and ionomer or their composite materials with said papers.

The substrate film 1 may vary in thickness to have proper strength, heat resistance, etc., but should preferably have a thickness ranging generally from 3 μm to 100 μm.

The transparent resin layer 2 formed on the substrate film 1 comprises a silicone-modified transparent resin.

The silicone-modified transparent resins used in the 3rd aspect of this invention may be obtained by grafting reactive silicone compounds on various transparent resins; the copolymerization of silicone segment-containing monomers with other monomer; or the addition or condensation polymerization of polyfunctional compound monomers with other polyfunctional monomers. A variety of resins suitable for the 3rd aspect of this invention may be commercially available. More illustratively, polyester silicone resin, polystyrene silicone resin, acrylic silicone resin, polyurethane silicone resin, acrylic urethane silicone resin or silicone-modified vinyl chloride/vinyl acetate polymer resin and mixtures thereof may preferably be used in the 3rd aspect of this invention. These resins excel in transparency, but tend to form films so relatively tough that they cannot be well cut at the time of transfer. For that reason, fine particles of high transparency such as those of silica, alumina, calcium carbonate and plastic pigments or waxes may be added to the transparent resins in such an amount as to have no adverse influence on their transparency.

The transparent resin layer 2 may be formed on the substrate film 1 or the release layer 3 which has been formed on it by coating thereon an ink preparation comprising the above-mentioned resin and wax by numerous means such as gravure coating, gravure reverse coating or roll coating, followed by drying. That layer 2 may preferably have a thickness of about 0.1 μm to about 20 μm.

When forming the aforesaid transparent resin layer, various images to be covered may be improved in terms of such properties as scratch resistance, gloss, light fastness, weather resistance and whiteness by incorporating in it such additives as slip agents, UV absorbers, antioxidants and/or fluorescent brighteners.

Prior to forming the transparent resin layer, it is preferred to provide the release layer 3 on the surface of the substrate film. Such a release layer is made of a releasant such as waxes, silicone wax, silicone resin, fluorocarbon resin and acrylic resin. The release layer 3 may be formed in similar manners as applied for forming the above-mentioned transparent resin layer, and may have a thickness of about 0.5 μm to about 5 μm. When it is desired to obtain a matted protective layer after transfer, various particles may be incorporated in the release layer. Alternatively, use may be made of a substrate film matted on its surface on which the release layer is to be provided.

When the heat transfer film used in this invention is particularly made of a polyester film rendered easily bondable, a water soluble polymer is used as the release layer. As such a water soluble polymer, use is preferably made of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic and water soluble polyamide, which may be used in combination of two or more to control releasability. The release layer may then have a thickness of about 0.01 μm to about 5 μm.

In order to make these layers more transferable, a heat-sensitive adhesive layer 5 may be additionally provided on the surface of the transparent resin layer. Such an adhesive layer, for instance, may be formed by coating on that surface resins of improved hot adhesiveness such as acrylic resin, vinyl chloride resin, vinyl chloride/vinyl acetate copolymer resin and polyester resin, followed by drying, and may have a thickness of about 0.1 μm to about 10 μm.

While the heat transfer cover film of the 3rd aspect of this invention is constructed as mentioned above, it is understood that the transparent resin layer may be provided on the substrate film independently or successively in combination with a sublimation type of dye layer and a wax ink layer.

Preferably, such a heat transfer cover film as mentioned above is used specifically, but not exclusively, to protect images obtained with the sublimation and/or wax types of heat transfer techniques. Especially when applied to sublimation transfer images, it does not only provide a protective layer for said images but makes them clearer as well, because the dyes forming them are again allowed to develop color due to the heat at the time of heat transfer.

It is also noted that the sublimation and/or wax types of transfer images may have been formed on any one of image-receiving materials heretofore known in the art. However, images formed on card materials made of polyester resin, vinyl chloride resin, etc. is preferable in this invention. Such card materials may be provided with embossments, signatures, IC memories, magnetic layers or other prints. Alternatively, they may be provided with embossments, signatures, magnetic layers, etc. after the heat transfer of the cover film.

How to produce a card with the heat transfer cover film according to the 3rd aspect of this invention will now be explained illustratively with reference to FIG. 2.

First, an yellow dye layer of a sublimation type of heat transfer sheet is overlaid on the surface of a card material 6 to transfer an yellow image 7Y thereonto with a thermal printer operating according to chromatic separation signals. Likewise, magenta and cyan images 7M and 7C are transferred onto the same region to produce a desired color image 7. Then, characters, signs and the like, shown at 8, are printed as desired, with a wax ink type of heat transfer sheet. Subsequently, the transparent resin layer is transferred onto the color image 7 and/or verbal image 8 to form a protective film 2, using the heat transfer cover film of this invention. In this manner, a desired card is obtained.

The thermal printer used for the above-mentioned heat transfer may be independently (or, preferably, continuously) accommodated to sublimation transfer, wax ink transfer and heat transfer covering. Alternatively, these transfer operations may be performed at properly regulated energy levels with a common printer. It is noted that as the heating means suitable for this invention, not only are thermal printers applicable but hot plates, hot rolls, irons or other units are also usable.

According to the 3rd aspect of this invention wherein a substrate film is releasably provided thereon with a silicone-modified transparent resin layer, which can be easily transferred onto the surface of a transfer image by the heat at the time of printing, it is possible to provide expeditious production of an excellent, curl-free image representation which is improved in terms of such properties as durability, esp. rub resistance, chemical resistance and solvent resistance.

Fourth Aspect

In the heat transfer cover film according to the 4th aspect of this invention, a substrate film 1 is releasably provided with a transparent resin layer 2, on which a heat-sensitive adhesive layer 5 is further formed.

It is noted that reference numeral 3 stands for a release layer provided to decrease the adhesion between the transparent resin layer and the substrate film, making the transfer of the transparent resin film easy. This layer 3 may be dispensed with when the transparent resin layer is well releasable from the substrate film.

A back layer 4 is provided to prevent a printer's thermal head from sticking to the substrate film. This layer 4 may again be omitted when the properties of the substrate film such as heat resistance and slip properties are satisfactory.

The heat transfer cover film according to the 4th aspect of this invention will now be explained in greater detail with reference to what it is made of and how to form it.

No particular limitation is imposed upon the material of which the substrate film 1 is made. Any material so far available for conventional heat transfer films may be used as such to this end. Other materials may, of course, be employed.

Illustrative examples of the material of which the substrate film 1 is made include tissues such as glassine paper, condenser paper and paraffin paper. Besides, use may be made of plastics such as polyester, polypropylene, cellophane, polycarbonate, cellulose acetate, polyethylene, polyvinyl chloride, polystyrene, nylon, polyimide, polyvinylidene chloride and ionomer or their composite materials with said papers.

The substrate film 1 may vary in thickness to have proper strength, heat resistance, etc., but should preferably have a thickness ranging generally from 3 μm to 100 μm.

The transparent resin layer 2 formed on the substrate film 1 may be made of various resins excelling in such properties as rub resistance, chemical resistance, transparency and hardness, e.g. polyester resin, polystyrene resin, acrylic resin, polyurethane resin and acrylic urethane resin, all being modified or not modified by silicone, or mixtures thereof. These resins excel in transparency, but tend to form films so relatively tough that they cannot be well cut at the time of transfer. Thus fine particles of high transparency such as those of silica, alumina, calcium carbonate and plastic pigments or wax may be added to these transparent resins in such an amount as to have no adverse influence on their transparency.

The transparent resin layer 2 may be formed on the substrate film 1 or the release layer 3 which has been formed on it by coating thereon an ink preparation comprising the above-mentioned resin and wax by numerous means inclusive of gravure coating, gravure reverse coating or roll coating, followed by drying. That layer 2 may preferably have a thickness of about 0.1 μm to about 20 μm.

When forming the above-mentioned transparent resin layer, various images to be covered may be improved in terms of such properties as scratch resistance, gloss, light fastness, weather resistance and whiteness by incorporating in it such additives as slip agents, UV absorbers, antioxidants and/or fluorescent brighteners.

Prior to forming the transparent resin layer, it is preferred to provide the release layer 3 on the surface of the substrate film. Such a release layer is made of a releasant such as waxes, silicone wax, silicone resin, fluorocarbon resin and acrylic resin. The release layer 3 may be formed in similar manners as applied for forming the above-mentioned transparent resin layer, and may have a thickness of about 0.5 μm to about 5 μm. When it is desired to obtain a matted protective layer after transfer, various particles may be incorporated in the release layer. Alternatively, use may be made of a substrate film matted on its surface on which the release layer is to be provided.

When the heat transfer film used in this invention is particularly made of a polyester film rendered easily bondable, a water soluble polymer is used as the release layer. As such a water soluble polymer, use is preferably made of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic and water soluble polyamide, which may be used in combination of two or more to control releasability. The release layer may then have a thickness of about 0.01 μm to about 5 μm.

In this aspect of the present invention, silicone-grafted acetal polymers in which silicone (polysiloxane) is grafted on the main chains of polymers may be used as the aforesaid releasant. When such a graft copolymer is used as the releasant, the content of the releasable segment (polysiloxane) in the releasant should preferably lie in the range of 10–80% by weight of the graft copolymer. At below 10% by weight the releasant fails to produce sufficient releasability, while at higher than 80% by weight its compatibility with a binder degrades, so that a dye migration problem arises. When added to the dye layer to be described hereinafter, the aforesaid releasants may be used alone or in admixture in an amount of 1 to 40 parts by weight per 100 parts by weight of the binder resin. At below 1 part by weight they fail to produce sufficient releasability, whereas at higher than 40 parts by weight they cause a drop of dye migration or coat strength, bring about dye discoloration and offers a problem in connection with dye storability.

The above-mentioned graft copolymer may also be used as a binder, in which case the releasable segment should preferably account for 0.5 to 40% by weight of the binder resin. In too small amounts the binder fails to produce sufficient releasability, whereas in too large amounts it causes drops of dye migration and coat strength, gives rise to dye discoloration and offers a problem in connection with dye storability.

In order to make these layers more transferable, it is additionally provided with the heat-sensitive adhesive layer 5 on the surface of the transparent resin layer. This layer 5 may be formed by the coating and drying of a solution of a thermoplastic resin whose Tg lies in the range of 40°–75° C., preferably 60°–70° C., e.g. a resin having an improved hot adhesiveness such as acrylic resin, polyvinyl chloride resin, polyvinyl acetate resin, vinyl chloride/vinyl acetate copolymer resin and polyester resin, and may preferably have a thickness of about 0.1 μm to about 10 μm.

At a Tg lower than 40° C., the aforesaid heat-sensitive adhesive layer is softened when the resulting image is used at a relatively high temperature, so that micro-cracking can occur an the transparent resin layer, resulting in degradation of its chemical resistance, esp. its resistance to plasticizers. At a Tg higher than 75° C., on the other hand, not only is the image to be covered made less adhesive to the transparent resin layer even with the heat emitted from a thermal head, but the "foil cutting" of the transparent resin layer also drops, making it difficult to perform transfer with high resolution.

Of the aforesaid heat-sensitive adhesives, the most preference is given to polyvinyl chloride resin, polyvinyl acetate resin and vinyl chloride/vinyl acetate copolymer resin, all having a polymerization degree of 50–300, preferably 50–250. At a polymerization degree lower than 50 such difficulties as is the case with low Tg's are experienced, whereas at higher than 300 such problems as is the case with high Tg's arise.

While the heat transfer cover film of the 4th aspect of this invention is constructed as mentioned above, it is understood that the transparent resin layer may be provided on the substrate film independently or successively in combination with a sublimation type of dye layer and a wax ink layer.

Preferably, such a heat transfer cover film as mentioned above is used specifically, but not exclusively, to protect images obtained with the sublimation and/or wax types of heat transfer techniques. Especially when applied to sublimation transfer images, it does not only provide a protective layer for said images but makes them clearer as well, because the dyes forming them are again allowed to develop colors due to heat at the time of heat transfer.

It is also noted that the sublimation and/or wax types of transfer images may have been formed on any one of image-receiving materials heretofore known in the art. However, images formed on card materials made of polyester resin, vinyl chloride resin, etc. is preferable in the 4th aspect of this invention. Such card materials may be provided with embossments, signatures, IC memories, magnetic layers or other prints. Alternatively, they may be provided with embossments, signatures, magnetic layers, etc. after the heat transfer of the cover film.

How to produce a card with the heat transfer cover film according to the 4th aspect of this invention will now be explained illustratively with reference to FIG. 2.

First, an yellow dye layer of a sublimation type of heat transfer sheet is overlaid on the surface of a card material 6 to transfer an yellow image 7Y thereonto with a thermal printer operating according to chromatic separation signals. Likewise, magenta and cyan images 7M and 7C are transferred onto the same region to produce a desired color image 7. Then, characters, signs and the like, shown at 8, are printed as desired, with a wax ink type of heat transfer sheet. Subsequently, the ionizing radiation-cured resin layer is transferred onto the color image 7 and/or verbal image 8 to form a protective film 2, using the heat transfer cover film of this invention. In this manner, a desired card is obtained.

The thermal printer used for the above-mentioned heat transfer may be independently (or, preferably, continuously) accommodated to sublimation transfer, wax ink transfer and heat transfer covering. Alternatively, these transfer operations may be performed at properly regulated energy levels with a common printer. It is noted that as the heating means suitable for this invention, not only are thermal printers applicable but hot plates, hot rolls, irons or other units are also usable.

Heat Transfer Process

Similar to those so far known in the art, the heat transfer sheet used in this invention may include a substrate film having a thickness of about 0.5 μm to about 50 μm, preferably about 3 μm to about 10 μm, for instance, a film made of polyethylene terephthalate, polystyrene, polysulfone and cellophane, and a dye layer formed thereon, comprising a sublimable dye, preferably a dye having a molecular weight of about 250 or higher and a binder resin based on, e.g. cellulose, acetal, butyral and polyester. This film is only different from the conventional ones in that said dye layer is permitted to contain a relatively large amount of a releasant.

It is noted that a releasant is added to both the dye layer and the dye-receiving layer in the prior art so as to prevent their fusion at the time of heat transfer. In the present disclosure, however, the wording "a relatively large amount" is understood to mean that a substantial portion or 100% by weight to 50% by weight of the releasant added is contained in the dye layer.

The releasant used in this invention, for instance, may be wax, silicone oil, surfactants based on phosphates and solid slip agents such as polyethylene powders, Teflon powders, talc and silica, all generally available and heretofore known in the art. However, preference is given to silicone resins.

As the aforesaid silicone resins, it is desired to use those modified by epoxy, long-chain alkyl, alkyl, amino, carboxyl, higher alcohols, fluoro-fatty acids, fatty acids, alkylaralkyl polyether, epoxy-polyether, polyether and the like by way of example.

The more preferable releasants used in this invention are silicone-modified resins in which silicone resins are bonded to vinylic, acrylic, polyester type and cellulosic resins by blocking or grafting. With these modified resins well compatible with the binder of the dye layer, it is possible to leave the migration, stability, capability of forming coats, etc. of the dye intact and make the transfer of it onto the dye-receiving layer less likely to occur at the time of heat transfer, thus doing no damage to the capability of the transparent protective layer of being laminated on the surface of the dye-receiving layer.

The aforesaid releasants may be used alone or in admixture, preferably accounting for 0.1 to 30% by weight, particularly 0.1 to 20% by weight of the dye layer. In too small amounts they fail to produce sufficient release effects, whereas in too large amounts they give rise to a drop of dye migration or coat strength and offer some problems in connection with dye discoloration and storability.

The heat transfer image-receiving sheet used to make images with such a heat transfer sheet as aforesaid may be made of any material with the recording surface being able to receive the aforesaid dye such as vinyl chloride resin. When made of dye receptivity-free materials such as films or sheets of pater, metals, glass or synthetic resins, it may provided on at least its one side with a dye-receiving layer made of a resin capable of receiving dyes satisfactorily such as polyester resin or vinylic resin, e.g. vinyl chloride/styrene copolymers or vinyl chloride/vinyl acetate copolymers.

Such a dye-receiving layer may contain such a releasant as aforesaid so as to facilitate sheet feeding and releasing and provide surface protection or for other purposes. However, that releasant should be used in small amounts, because it is difficult to laminate the transparent protective layer on the dye-receiving layer containing a large amount of the releasant. The amount of the releasant, when added, should be not higher than 50% by weight, preferably 30% by weight of the amount of the releasant which has been contained in both the dye layer and the dye-receiving layer so as to improve the releasability therebetween. More specifically, that releasant has to be used in an amount of not higher than 1 part by weight, preferably 0.5 parts by weight per 100 parts by weight of the resin forming the dye-receiving layer.

According to the heat transfer process of this invention, the aforesaid heat transfer sheet and image-receiving sheet are used to laminate the transparent protective layer on the resulting image. A particularly preferable embodiment will now be explained with reference to the accompanying drawings.

Figure 3:
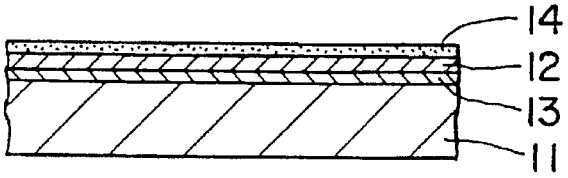
Figure 4:
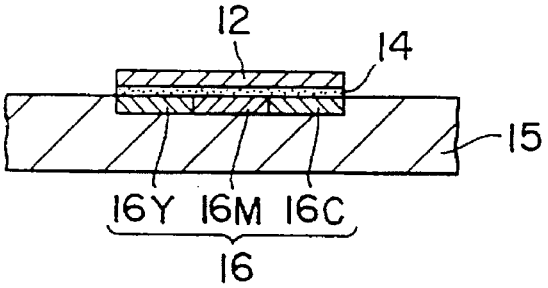

FIG. 3 is a diagrammatic view showing the section of the heat transfer sheet having a transparent protective layer used in this invention, in which the 1st–4th aspects of this invention, as already explained, are embraced too. FIG. 4 is a diagrammatical view illustrating the section of the heat transfer image obtained in accordance with this invention.

Referring to a general structure of the heat transfer cover film used in this embodiment, a transferable transparent protective layer 12 is provided on a substrate film 11.

The substrate film 11 may be made of a material similar that used for the aforesaid heat transfer sheet. As the transparent resins employed for the aforesaid transparent protective film 1, use may be made of, in addition to such resins as mentioned in connection with the 1st to 4th aspects, acrylic resin, acrylic/vinyl chloride/vinyl acetate copolymer resin, chlorinated rubber, acrylic/chlorinated rubber resin, vinyl chloride/vinyl acetate copolymer resin, ultraviolet ray- or electron beam-curable resin and so on. The substrate film may preferably have a thickness of about 0.5 μm to about 10 μm.

When forming the aforesaid transparent protective layer 12, various images to be covered thereby are improved in terms of such properties as gloss, light fastness, resistance to discoloration and fading in the dark, weather resistance and whiteness by incorporating therein such additives as UV absorbers, antioxidants and/or fluorescent brighteners. In order to improve scratch resistance and printability, that protective layer may also contain waxes and fine particles (such as polyethylene powders and microsilica).

Prior to forming the aforesaid transparent protective layer 12, it is preferable to provide a release layer 13 on the surface of the substrate film 11. Such a release layer 13, for instance, is made of such materials as acrylic resin, acrylic/vinyl chloride/vinyl acetate copolymer resin, chlorinated polypropylene resin and waxes, e.g. carnauba wax. Preferably, that release layer has a thickness of about 0.1 μm to about 2 μm.

It is understood that such a release layer may be forwent when the substrate film 11 is well releasable from the transparent protective layer 12.

When the heat transfer film used in this invention is particularly made of a polyester film rendered easily bondable, a water soluble polymer is used as the release layer. As such a water soluble polymer, use is preferably made of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic and water soluble polyamide, which may be used in combination of two or more to control releasability. The release layer may then have a thickness of about 0.01 μm to about 5 μm.

In order to make these layers more transferable, a heat-sensitive adhesive layer 14 may be additionally provided on the surface of the transparent resin layer 12. This adhesive layer 14, for instance, may be made of resins having an improved hot adhesiveness such as acrylic resin, vinyl chloride resin, vinyl chloride/vinyl acetate copolymer resin, chlorinated polypropylene resins, polyester resin and polyamide resin, and may have preferably a thickness of about 0.3 μm to about about 5 μm.

It is understood that such an adhesive layer 14 may be dispensed with when the transparent resin layer 12 is improved in terms of hot adhesiveness.

The present process using the aforesaid heat transfer cover film will now be explained with reference to FIG. 4.

For instance, an yellow dye layer of the heat transfer sheet is first overlaid on the surface of a heat transfer image-receiving sheet 15 to transfer an yellow image 16Y thereonto with a thermal printer operating according to color separation signals. Likewise, magenta and cyan images 16M and 16G may be transferred to form a desired color image 16.

Then, a transparent protective layer 12 is transferred onto the image 16 with the aforesaid heat transfer cover film. In this manner, the color image 16 having the desired transparent protective layer 12 laminated thereon is obtained.

Figure 5:
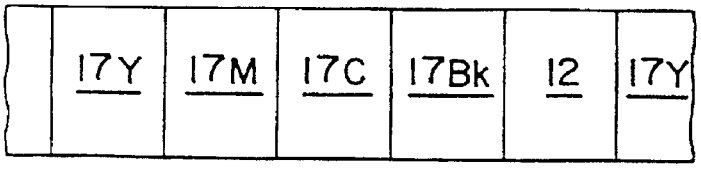
FIG. 5 is a plan view of one embodiment of the heat transfer cover film.

While the present invention has been described with reference to its preferred embodiment, other embodiments are also envisioned. For instance, the transparent protective layer 12 may be located adjacent to the dye layer 17 of the heat transfer sheet, as illustrated in FIG. 5. Moreover, transparent protective films may be formed by the lamination of generally available transparent resin films or the coating of transparent resin coating materials.

It is also understood that the lamination of the transparent protective layer may be achieved not only through the thermal head of the thermal printer used for heat transfer but also with laminators, hot rolls, irons or other known equipment or, possibly, in coating manners.

According to this invention wherein, as aforesaid, the dye layer is allowed to contain a substantial portion of the releasant in such an amount as to assure easy separation of the dye layer from the dye-receiving layer at the time of heat transfer, while the dye-receiving layer is releasant-free or permitted to contain the releasant in such an amount as to offer no impediment to the lamination of the transparent protective layer, the transparent protective layer can be easily transferred onto the surface of the image formed by heat transfer, thus making it possible to make an image representation improved in terms of such properties as durability, esp. rub resistance, resistance to staining, light fastness, resistance to discoloration and fading in the dark and storability.

Production of Heat Transfer Sheet and Card

Such items of information as characters, signs and bar codes carried on cards, e.g. ID cards are required to be recorded in black at high density rather than on a gray scale. Thus such items of information are desired to be recorded with a heat meltable type of heat transfer sheet. With that purpose in mind, there has been proposed a mixed type of heat transfer sheet in which a sublimation type of dye layer and a heat meltable of ink layer are successively provided on the same substrate sheet (see Japanese Patent Laid-Open Publication (KOKAI) No. 63-9574).

With this mixed type of heat transfer sheet, excellent gray scale images for photographs for faces, etc. are formed together with monochromic, high-density images for characters, signs and the like.

In the case of such a mixed type of heat transfer sheet as aforesaid, it is required for the sublimation type of dye layer that only the dye migrate onto the image-receiving material while the binder remain on the substrate sheet. In other words, the dye layer is required to be well adhesive to the substrate sheet. For the wax type of ink layer, it is required that the ink layer be transferred onto the image-receiving material in its entirety. To put it another way, the ink layer should be well releasable from the substrate sheet.

Such requirements may possibly be met by forming a heat meltable type of ink layer with a well-releasable substrate sheet and forming an adhesive layer on its region to be provided with a sublimation type of dye layer or, alternatively, providing a substrate sheet including an adhesive layer with a release layer and forming a heat meltable ink layer on that release layer. A problem with forming such an adhesive layer, however, is that the heat sensitivity of the sublimable dye layer is so decreased that no satisfactory gray scale image can be obtained, because more energy is generally required for the heat transfer of the sublimable dye layer than for the transfer of the heat meltable ink layer. To avoid this, the adhesive layer should be made as thin as possible. Still, some difficulty has been involved so far in providing an adhesive layer of the order of submicrons uniformly, thus offering such problems as unevenness of printing and unusual (or overall) transfer of dye layers.

In order to provide a solution to such problems, the present invention provides a heat transfer sheet including a substrate sheet having on the same surface a first heat transfer layer comprising a thermally migrating dye and an untransferable binder and a second heat transfer layer comprising a dyed or pigmented, heat meltable binder, characterized in that the substrate sheet is formed of a polyester film made easily bondable on at least its surface to be provided with the heat transfer layers.

By using this heat transfer sheet in combination with the aforesaid heat transfer cover film, it is possible to obtain high-quality image representations.

The aforesaid heat transfer sheet will now be explained more illustratively with reference to its preferred embodiments.

In the present disclosure, the "polyester film made easily bondable" refers to a polyester film provided thereon with a very thin, uniform adhesive layer. In order to obtain such an adhesive layer, it is preferred that heat-, catalyst- and ionizing radiation-curable type of crosslinked resins, for instance, polyurethane, acrylic, melamine or epoxy resins are first dispersed in water or dissolved in organic solvents to prepare coating solutions. They may then be coated on the aforesaid polyester film by any desired coating means, for instance, blade coating, gravure coating, rod coating, knife coating, reverse roll coating, spray coating, offset gravure coating or moss coating, followed by drying.

Of importance in this case is the thickness of the adhesive layer formed. At too large a thickness the heat sensitivity of the sublimation type of dye layer drops, whereas at too small a thickness such unusual transfer of dye layers as mentioned above takes place. Thus the adhesive layer should have a thickness lying in the range of 0.001 to 1 μm, preferably 0.05 to 0.5 μm.

It is particularly preferred that the adhesive layer formed be of uniform thickness. For instance, this is achieved by forming a few-μm thick adhesive layer before stretching the polyester film and then biaxially stretching that film, whereby the adhesive layer can be made uniform and reduced to as thin as 1 μm or less in thickness.

Particularly preferable as the aforesaid polyester film is a film of polyethylene terephthalate or polyethylene naphthalate, which is commercially available or may be prepared by known methods (see, for instance, Japanese Patent Laid-Open Publication Nos. 62-204939 and 62-257844).

Such a substrate sheet as aforesaid may have a thickness enough to assure some heat resistance and strength, say, 0.5 to 50 μm, preferably about 3 μm to about 10 μm.

The sublimation type of dye layer that is the first heat transfer layer formed on the surface of the substrate sheet contains a sublimable dye carried by any desired binder resin.

Any dye so far used for conventional known heat transfer sheets may be effectively applied to this end without exception. By way of example alone, use may be made of dye reds such as MS Red G, Macrolex Red Violet R, Ceres Red 7B, Samaron Red HBSL and Resolin Red F3BS; yellow dyes such as Foron Brilliant Yellow 6GL, PTY-52 and Macrolex Yellow 6G; and blue dyes such as Kayaset Blue 714, Vacsolin Blue AP-FW, Foron Brilliant Blue S-R and MS Blue 100.

Known resins may all be used as the binders for carrying such dyes as aforesaid. By way of example, preferable are cellulosic resins such as ethylcellulose, hydroxyethylcellulose, ethylhydroxycellulose, hydroxypropylcellulose, methylcellulose, cellulose acetate and cellulose acetate butyrate; vinylic resins such as polyvinyl alcohol, polyvinyl acetate, polyvinyl butyral, polyvinyl acetal, polyvinyl pyrrolidone and polyacrylamide; polyester; and the like. Of these resins, preference is given to resins based on cellulose, acetal, butyral and polyester in consideration of such properties as heat resistance and dye migration.

Such a dye layer may preferably be formed by dissolving or dispersing the aforesaid sublimable dye and binder resin as well as other components, e.g. releasants in suitable solvents to prepare a coating or ink material for forming the dye layer and coating it on the aforesaid substrate sheet, followed by drying.

The dye layer formed in this manner may have a thickness of 0.2 to 5.0 μm, preferably about 0.4 to about 2.0 μm, and the sublimable dye may preferably account for 5 to 90% by weight, preferably 10 to 70% by weight of the dye layer.

When it is desired to obtain a monochromic image, the dye layer may be made from one selected from the group consisting of the aforesaid dyes. When it is desired to obtain a full-color image, on the other hand, the dye layer may be formed choosing suitable cyan, magenta and yellow (and, if necessary, black) dyes.

In this invention, the heat meltable ink layer is located in parallel to the aforesaid sublimable dye layer or layers. In what order these dye layers are arranged is not critical. For instance, yellow, magenta and cyan dye layers and a heat-meltable, black ink layer may be successively formed according to an A4 size.

The aforesaid ink layer comprises a dyed or pigmented, heat-meltable binder. A preferable colorant is carbon black, but other dyes or pigments of different hues may be used as well.

The binder used may be a thermoplastic resin or wax having a relatively low melting point or their mixture, but care should preferably taken of its adhesion to the associated image-receiving material. For instance, when the image-receiving material is a vinyl chloride resin often used for ID cards, thermoplastic resins such as (meth)acrylic ester, vinyl chloride/vinyl acetate copolymer resin, ethylene/vinyl acetate copolymer resin and polyester resin are preferable.

In order to form the heat meltable ink layer on the substrate sheet, the aforesaid ink materials may be coated thereon by not only hot melt coating but also a number of other coating means as well, inclusive of hot melt coating, hot lacquer coating, gravure coating, gravure reverse coating and roll coating. Required to be determined with harmony between the required density and heat sensitivity in mind, the ink layer formed preferably lies in the range of 0.2 to 3.0 μm. At too small a thickness the reflection density of the transfer image is insufficient, whereas at too large a thickness the "foil cutting" at the time of printing degrades, resulting in a drop of the sharpness of the printed image.

In this invention, the substrate sheet has preferably included a release protective layer on its surface before forming the aforesaid ink layer. This release protective layer serves to improve the releasability of the ink layer and is transferred along with the ink layer, giving a surface protective layer on the transfer image and thereby improving its rub resistance, etc. Such a release protective layer may be made of (meth)acrylic resin, silicone base resin, fluorine base resin, cellulosic resin such as cellulose acetate, epoxy base resin, polyvinyl alcohol and the like, which contain waxes, organic pigments, inorganic pigments and the like, and may preferably have a thickness of 0.2 to 2.5 μm. At too small a thickness it fails to produce sufficient protective effects such as scratch resistance, whereas at too large a thickness the "foil cutting" at the time of printing goes worse.

In this invention, it is preferred that a heat-sensitive adhesive layer be additionally provided on the aforesaid ink layer. This adhesive layer should again be chosen in consideration of its adhesion to the associated image-receiving material. For instance, when the image-receiving material is a card material made of a resin based on vinyl chloride, it is preferable to use such a well-adhesive thermoplastic resin as aforesaid. The adhesive layer formed should preferably have a thickness lying in the range of 0.05 to 1.0 μm. At too small a thickness no desired adhesion is obtained, whereas at too large a thickness the "foil cutting" at the time of printing goes worse.

The aforesaid heat transfer sheet may also include such a cover film as illustrated in FIG. 1 or 3.

In the present invention, it is further preferred that the aforesaid substrate sheet be provided on its back surface with a heat-resistant slip layer adapted to prevent a thermal head from sticking to it and improve its slip properties.

The image-receiving material used to make images with such a heat transfer sheet as aforesaid may be made of any material with the recording surface showing dye receptivity with respect to the aforesaid dye. When made of a dye receptivity-free material such as paper, metals, glass or synthetic resin, it may have been provided with a dye-receiving layer on at least its one surface.

The heat transfer sheet of this invention is particularly fit for the preparation of cards made of polyvinyl chloride resin. With no need of forming any special dye-receiving layer, a gray scale image comprising the sublimable dye layer and characters, signs, bar codes, etc. comprising the meltable ink layer may be printed directly on these card materials.

In this invention, a particularly preferable card material contains a plasticizer in an amount of 0.1 to 10 parts by weight, preferably 1 to 5 parts by weight per 100 parts by weight of polyvinyl chloride. Moreover, it should be well receptible with respect to the sublimable dye and well adhesive to the meltable ink.

In a more preferred embodiment, the card material contains, in addition to the aforesaid plasticizer, a slip agent in an amount of 0.1 to 5 parts by weight per 100 parts by weight of-polyvinyl chloride. According to that embodiment, it is found that even when a relatively large amount, e.g. 1 to 5 parts by weight of the plasticizer is incorporated in the polyvinyl chloride, the card material offers no blocking problem with respect to the heat transfer sheet, and is improved in terms of its receptivity with respect to the sublimable dye.

Such a polyvinyl chloride card material as aforesaid may be obtained by blending together the required components and forming the blend into a sheet of, e.g. about 0.05 mm to about 1 mm in thickness by known means such as calendering or extrusion, and may be in the form of either a card or a sheeting which will be cut into card size. Also, the card material may be of a monolayer or multilayer structure, in which latter case, for instance, a white pigment-containing center core is provided with a transparent resin layer on at least its one surface.

It is understood that the heat transfer sheet of this invention is never limited to preparing polyvinyl chloride cards. For instance, it is not only suited for making image-receiving materials other than cards, e.g. passports, to say nothing of polyester cards, but is also useful for producing various prints inclusive of less sophisticated catalogs, for which gray scale images and monochromic images for characters, signs, bar codes, etc. are required at the same time.

Energy applicator means so far known in the art may all be used to apply heat energy to carry out heat transfer with such heat transfer sheet and image-receiving material as mentioned above. For instance, the desired images may be obtained by the application of a heat energy of about 5 $mJ/mm^2$ to about 100 $mJ/mm^2$ for a time controlled by recording hardware such as a thermal printer (e.g. Video Printer VY-100 made by Hitachi, Ltd.)

According to this invention wherein the substrate sheet used is a polyester film made easily bondable, as described above, there is provided a heat transfer sheet capable of forming clear gray scale images and clear verbal or other images at the same time. With this heat transfer sheet, it is possible to provide an excellent card.

The present invention will now be explained more illustratively with reference to the reference examples, examples, application examples and comparative examples, wherein unless otherwise stated, the "parts" and "%" are given by weight.

REFERENCE EXAMPLE A1

Three ink compositions containing sublimable dyes of different colors were prepared with the components mentioned just below.

| Yellow Ink | |
|---|---|
| Disperse dye (Macrolex Yellow 6G made by Bayer Co., Ltd.) | 5.5 parts |
| Polyvinyl butyral resin (Eslec BX-1 made by Sekisui Chemical Co., Ltd.) | 4.5 parts |
| Methyl ethyl ketone/toluene (at a weight ratio of 1:1) | 89.5 parts |

Magenta Ink

This ink was similar to the yellow ink with the exception that a magenta disperse dye (Disperse Red 60) was used.

Cyan Ink

This ink was similar to the yellow ink, provided that a cyan disperse dye (Solvent Blue 63) was used.

Provided as a substrate film was a 6.0-μm thick polyester film Lumirror made by Toray Industries, Ltd.) having on its back surface a heat-resistant slip layer (of 1 μm in thickness) and on its front surface a primer layer (of 0.5 μm in thickness) comprising a polyurethane base resin. Using gravure coating, the aforesaid ink compositions were successively and repeatedly coated on the front surface of the substrate film in the order of yellow, magenta and cyan, at a width of 15 cm and to a coverage of about 3 $g/m^2$. Subsequent drying gave a sublimation type of heat transfer sheet containing sublimable dye layers of three different colors.

REFERENCE EXAMPLE A2

The following wax ink composition, heated at a temperature of 100° C., was coated on the same substrate film as used in Reference Ex. A1 but including no primer layer, to a coverage of about 4 $g/m^2$ by hot melt roll coating, thereby preparing a wax type of heat transfer sheet.

| Wax Ink | |
|---|---|
| Ester wax | 10 parts |
| Wax oxide | 10 parts |
| Paraffin wax | 60 parts |
| Carbon black | 12 parts |

EXAMPLE A1

Using gravure coating, the following ink composition was coated on the same substrate film as used in Reference Ex. A2 at a ratio of 1 $g/m^2$ on dry solid basis. Subsequent drying gave a release layer.

| Ink for Release Layer | |
|---|---|
| Silicone base resin | 10 parts |
| Vinyl chloride/vinyl acetate copolymer | 10 parts |
| Methyl ethyl ketone | 100 parts |
| Toluene | 100 parts |

Then, the following ink was coated on the surface of the aforesaid release layer at a ratio of 10 $g/m^2$ on dry solid basis. Subsequent drying gave an ionizing radiation-curable resin layer.

| Ink for Ionizing Radiation-Curable Resin Layer | |
|---|---|
| Dipentaerythritol hexacrylate | 40 parts |
| Hydrophobic colloidal silica | 40 parts |
| Polymethyl methacrylate | 20 parts |
| Polyethylene wax | 3 parts |
| Methyl ethyl ketone | 250 parts |
| Toluene | 250 parts |

Then, the following ink composition was coated on the surface of the aforesaid resin layer at a ratio of 1 $g/m^2$ on dry solid basis, followed by drying which gave an adhesive layer. After that, the product was exposed to electron beams of 180 KV at a dose of 5 Mrad in a nitrogen atmosphere of $10^{-7}$ Torr with an electron beam irradiator made by Nisshin High Voltage Co., Ltd. to cure the ionizing radiation-curable resin layer, thereby obtaining a heat transfer cover film according to this invention.

| Ink for Adhesive Layer | |
|---|---|
| Vinyl chloride/vinyl acetate copolymer | 10 parts |
| Methyl ethyl ketone | 100 parts |
| Toluene | 100 parts |

EXAMPLE A2

The procedures of Example A1 were followed with the exception that the following ionizing radiation-curable ink was used, thereby obtaining a heat transfer cover film according to this invention.

| Ink for Ionizing Radiation-Cured Resin Layer | |
|---|---|
| Trimethylolpropane triacrylate | 60 parts |
| Talc (Microace L-1 made by Nippon Talc Co., Ltd.) | 10 parts |

-continued

| Ink for Ionizing Radiation-Cured Resin Layer | |
|---|---|
| Polymethyl methacrylate | 30 parts |
| Fluorine base surfactant (Flow Lard 432 made by Sumitomo 3M Co., Ltd.) | 3 parts |
| Methyl ethyl ketone | 200 parts |
| Toluene | 200 parts |

Application Example A1

The sublimable dye layer of the sublimation type of heat transfer film of Reference Ex. A1 was overlaid on the surface of a card material comprising 100 parts of a compound of polyvinyl chloride—having a polymerization degree of 800—containing about 10% of such additives as a stabilizer, 10 parts of a white pigment (titanium oxide) and 0.5 parts of a plasticizer (DOP), and heat energy was then applied thereto through a thermal head connected to electrical signals obtained by the chromatic separation of a photograph of face to form a full-color image thereof. Subsequently, characters and signs were reproduced with the wax type of heat transfer film of Reference Ex. A2. Finally, a transferable protective layer was transferred onto the respective imaged regions with the heat transfer cover film according to Example A1 of this invention to obtain a card bearing the photograph of face and the required pieces of information.

Application Example A2

The procedures of Application Ex. A1 were followed with the exception that the heat transfer cover film of Example A2 was used, thereby preparing a card.

Comparative Example A1

The procedures of Application Example A1 were followed with the exception that no ionizing radiation-cured resin layer was transferred, thereby preparing a card.

Comparative Example A2

A cover film was prepared by following the procedures of Example A1 provided that the following ink was used in place of the ink for the ionizing radiation-cured resin layer. With this cover film, a card was made by following the procedures of Application Example A1.

| Ink for Protective Layer | |
|---|---|
| Polyester resin (U-18 made by Arakawa Kagaku K.K.) | 20 parts |
| Methyl ethyl ketone | 50 parts |
| Toluene | 50 parts |

Comparative Example A3

A cover film was prepared by following the procedures of Example A1 provided that the following ink was used in place of the ink for the ionizing radiation-cured resin layer. With this cover film, a card was made by following the procedures of Application Example A1.

| Ink for Protective Layer | |
|---|---|
| Cellulose resin (CAB381-0.1) | 20 parts |
| Methyl ethyl ketone | 50 parts |
| Toluene | 50 parts |

Results of Estimation

The cards obtained as aforesaid were estimated. The results are reported in Table 1 given just below.

TABLE 1

| | Film Cutting | | Rub Resistance | Gloss | Pencil Hardness |
|---|---|---|---|---|---|
| A.Ex. | A1 | ⊙ | ⊙ | 72% | 2H |
| | A2 | ⊙ | ⊙ | 81% | 2H |
| C.Ex. | A1 | — | x | 14% | 4B |
| | A2 | x | ○ | 59% | H |
| | A3 | x | ○ | 28% | H |

A.Ex: Application Example
C.Ex: Comparative Example
Film Cutting: Determined in terms of the releasability of films after transfer and by observing the transfer images under a microscope.
⊙:Releasing is very easy and the ionizing radiation-cured resin layers are sharply cut along the contours of the the images.
x: There is considerable resistance to releasing with the edges of the resin layers lacking uniformity.
Rub Resistance: Measured by rubbing the surfaces of the images 100 times with gauze impregnated with isopropyl alcohol.
⊙: The gauze is not stained at all.
○: The gauze is somewhat stained.
x: The gauze is badly stained.
Gloss: Determined in terms of gloss value in %.

REFERENCE EXAMPLE B1

Three ink compositions containing sublimable dyes of different colors were prepared with the components mentioned just below.

| Yellow Ink | |
|---|---|
| Disperse dye (Macrolex Yellow 6G made by Bayer Co., Ltd.) | 5.5 parts |
| Polyvinyl butyral resin (Eslec BX-1 made by Sekisui Chemical Co., Ltd.) | 4.5 parts |
| Methyl ethyl ketone/toluene (at a weight ratio of 1:1) | 89.0 parts |

Magenta Ink

This ink was similar to the yellow ink with the exception that a magenta disperse dye (Disperse Red 60) was used.

Cyan Ink

This ink was similar to the yellow ink, provided that a cyan disperse dye (Solvent Blue 63) was used.

Provided as a substrate film was a 6.0-μm thick polyester film (Lumirror made by Toray Industries, Ltd.) having on its back surface a heat-resistant slip layer (of 1 μm in thickness) and on its front surface a primer layer (of 0.5 μm in thickness) comprising a polyurethane base resin. Using gravure coating, the aforesaid ink compositions were successively and repeatedly coated on the front surface of the substrate film in the order of yellow, magenta and cyan, at a width of 15 cm and to a coverage of about 3 g/m$^2$. Subsequent drying gave a sublimation type of heat transfer sheet containing sublimable dye layers of three different colors.

REFERENCE EXAMPLE B2

The following wax ink composition, heated at a temperature of 100° C., was coated on the same substrate film as used in Reference Ex. B1 but including no primer layer, to a coverage of about 4 g/m$^2$ by hot melt roll coating, thereby preparing a wax type of heat transfer sheet.

| Wax Ink | |
|---|---|
| Acrylic/vinyl chloride/vinyl acetate copolymer resin | 20 parts |
| Carbon black | 10 parts |

-continued

| Wax Ink | |
|---|---|
| Toluene | 35 parts |
| Methyl ethyl ketone | 35 parts |

EXAMPLE B1

Using gravure coating, the following ink composition was coated on the same substrate film as used in Reference Ex. B2 at a ratio of 1 g/m$^2$ on dry solid basis. Subsequent drying gave a release layer.

| Ink for Release Layer | |
|---|---|
| Acrylic resin | 20 parts |
| Methyl ethyl ketone | 100 parts |
| Toluene | 100 parts |

Then, the following ink was coated on the surface of the aforesaid release layer at a ratio of 3 g/m$^2$ on dry solid basis. Subsequent drying gave a transparent resin layer.

| Ink for Transparent Resin Layer | |
|---|---|
| Acrylic resin | 20 parts |
| Polyethylene wax | 1 part |
| Methyl ethyl ketone | 50 parts |
| Toluene | 50 parts |

Then, the following ink composition was coated on the surface of the aforesaid resin layer at a ratio of 1 g/m$^2$ on dry solid basis, followed by drying which gave an adhesive layer. In this way, a heat transfer cover film according to this invention was prepared.

| Ink for Adhesive Layer | |
|---|---|
| Acrylic resin | 10 parts |
| Vinyl chloride/vinyl acetate copolymer | 10 parts |
| Methyl ethyl ketone | 100 parts |
| Toluene | 100 parts |

EXAMPLE B2

The procedures of Example B1 were followed with the exception that the following ink for the transparent resin layer was used, thereby obtaining a heat transfer cover film according to this invention.

| Ink for Transparent Resin Layer | |
|---|---|
| Aqueous emulsion of acrylic resin (with a solid matter content of 30%) | 20 parts |
| Aqueous emulsion of paraffin wax (with a solid matter content of 30%) | 3 parts |
| Water | 20 parts |
| Isopropyl alcohol | 10 parts |

Application Example B1

The sublimable dye layer of the sublimation type of heat transfer film of Reference Ex. B1 was overlaid on the surface of a card substrate comprising 100 parts of a compound of polyvinyl chloride—having a polymerization degree of 800—containing about 10% of such additives as a stabilizer, 10 parts of a white pigment ( titanium oxide) and 0.5 parts of a plasticizer (DOP), and heat energy was then applied thereto with a thermal head connected to electrical signals obtained by the chromatic separation of a photograph of face to form a full-color image thereof. Subsequently, characters and signs were reproduced with the wax type of heat transfer film of Reference Ex. B2. Finally, a transferable protective layer was transferred onto the respective imaged regions with the heat transfer cover film according to Example B1 of this invention to obtain a card bearing the photograph of face and the required pieces of information.

Application Example B2

The procedures of Application Ex. B1 were followed with the exception that the heat transfer cover film of Example B2 was used, thereby preparing a card.

Comparative Example B1

The procedures of Application Example B1 were followed with the exception that no transparent resin layer was transferred, thereby preparing a card.

Comparative Example B2

A cover film was prepared by following the procedures of Example B1 provided that the following ink for the transparent resin layer was used. With this cover film, a card was made by following the procedures of Application Example B1.

| Ink for Transparent Resin Layer | |
|---|---|
| Acrylic resin | 21 parts |
| Methyl ethyl ketone | 50 parts |
| Toluene | 50 parts |

Results of Estimation

The cards obtained as aforesaid were estimated. The results are reported in Table 2 given just below.

TABLE 2

| | | Film Cutting | Rub Resistance | Gloss B.T. | Gloss A.T. |
|---|---|---|---|---|---|
| A.Ex. | B1 | o | ⊙ | 82% | 78% |
| | B2 | ⊙ | ⊙ | 73% | 71% |
| C.Ex. | B1 | — | x | 14% | 7% |
| | B2 | x | ⊙ | 81% | 43% |

B.T.: Before Test
A.T.: After Test
Film Cutting: Determined in terms of the releasability of films after transfer and by observing the transfer images under a microscope.
⊙: Releasing is very easy and the transparent resin layers are sharply cut along the contours of the images.
o: There is some resistance to releasing with the edges of the transparent resin layers lacking uniformity slightly.
x: There is considerable resistance to releasing with the edges of the transparent resin layers lacking uniformity.
Rub Resistance: Measured by rubbing the surfaces of the images 100 times with gauze impregnated with isopropyl alcohol.
⊙: The gauze is not stained at all.
x: The gauze is badly stained.
Gloss: Determined by rubbing the images 100 times with synthetic paper to measure a change in glossiness (gloss value in %).

REFERENCE EXAMPLE C1

Three ink compositions containing sublimable dyes of different colors were prepared with the components mentioned just below.

| Yellow Ink | |
|---|---|
| Disperse dye (Macrolex Yellow 6G made by Bayer Co., Ltd.) | 5.5 parts |
| Polyvinyl butyral resin (Eslec BX-1 made by Sekisui Chemical Co., Ltd.) | 4.5 parts |
| Methyl ethyl ketone/toluene (at a weight ratio of 1:1) | 89.5 parts |

Magenta Ink

This ink was similar to the yellow ink with the exception that a magenta disperse dye (Disperse Red 60) was used.

Cyan Ink

This ink was similar to the yellow ink, provided that a cyan disperse dye (Solvent Blue 63) was used.

Provided as a substrate film was a 6.0-μm thick polyester film (Lumirror made by Toray Industries, Ltd.) having on its back surface a heat-resistant slip layer (of 1 μm in thickness) and on its front surface a primer layer (of 0.5 μm in thickness) comprising a polyurethane base resin. Using gravure coating, the aforesaid ink compositions were successively and repeatedly coated on the front surface of the substrate film in the order of yellow, magenta and cyan, at a width of 15 cm and to a coverage of about 3 g/m$^2$. Subsequent drying gave a sublimation type of heat transfer sheet containing sublimable dye layers of three different colors.

REFERENCE EXAMPLE C2

The following wax ink composition, heated at a temperature of 100° C., was coated on the same substrate film as used in Reference Ex. C1 but including no primer layer, to a coverage of about 4 g/m$^2$ by hot melt roll coating, thereby preparing a wax type of heat transfer sheet.

| Wax Ink | |
|---|---|
| Acrylic/vinyl chloride/vinyl acetate copolymer resin | 20 parts |
| Carbon black | 10 parts |
| Toluene | 35 parts |
| Methyl ethyl ketone | 35 parts |

EXAMPLE C1

Using gravure coating, the following ink composition was coated on the same substrate film as used in Reference Ex. C2 at a ratio of 1 g/m$^2$ on dry solid basis. Subsequent drying gave a transparent resin layer.

| Ink for Transparent Resin Layer | |
|---|---|
| Acrylic silicone resin (US310 made by Toa Gosei K.K.) | 60 parts |
| Microsilica | 20 parts |
| Methyl ethyl ketone | 20 parts |
| Toluene | 20 parts |

Then, the following ink was coated on the surface of the aforesaid resin layer at a rate of 0.5 g/m$^2$ on dry solid basis. Subsequent drying gave an adhesive layer. In this way, a heat transfer cover film according to this invention was obtained.

| Ink for Adhesive Layer | |
|---|---|
| Nylon (FS-175SV16 made by Toa Gosei K.K.) | 50 parts |
| Microsilica | 0.4 parts |
| Modified ethanol | 50 parts |

EXAMPLE C2

The procedures of Example C1 were followed with the proviso that the following ink for the transparent resin layer was used, thereby obtaining a heat transfer cover film according to this invention.

| Ink for Transparent Resin Layer | |
|---|---|
| Acryl silicone resin (US350 made by Toa Gosei K.K.) | 60 parts |
| Microsilica | 0.4 parts |
| Methyl ethyl ketone | 20 parts |
| Toluene | 20 parts |

Application Example C1

The sublimable dye layer of the sublimation type of heat transfer film of Reference Ex. C1 was overlaid on the surface of a card substrate comprising 100 parts of a compound of polyvinyl chloride—having a polymerization degree of 800—containing about 10% of such additives as a stabilizer, 10 parts of a white pigment (titanium oxide) and 0.5 parts of a plasticizer (DOP), and heat energy was then applied thereto with a thermal head connected to electrical signals obtained by the chromatic separation of a photograph of face to form a full-color image thereof. Subsequently, characters and signs were reproduced with the wax type of heat transfer film of Reference Ex. C2. Finally, a transferable protective layer was transferred onto the respective imaged regions with the heat transfer cover film according to Example C1 of this invention to obtain a card bearing the photograph of face and the required pieces of information.

Application Example C2

The procedures of Application Ex. C1 were followed with the exception that the heat transfer cover film of Example C2 was used.

Comparative Example C1

The procedures of Application Ex. C1 were followed with the proviso that no transparent resin layer was transferred.

Comparative Example C2

The procedures of Application Ex. C1 were followed with the proviso that the following ink compositions for the transparent resin and adhesive layers were used, thereby obtaining a cover film. With this cover film, a card was prepared by following the procedures of Application Ex. C1.

| Ink for Transparent Resin Layer | |
|---|---|
| Acrylic resin (BR-83 made by Mitsubishi Rayon Co., Ltd.) | 20 parts |
| Polyethylene wax | 1 part |
| Methyl ethyl ketone | 40 parts |
| Toluene | 10 parts |
| (Coated to a coverage of 4 g/m$^2$). | |
| **Ink for Adhesive Layer** | |
| HS-32G (made by Showa Ink Kogyo K.K.) | 50 parts |
| Microsilica | 2 parts |
| Ethyl acetate | 25 parts |
| Toluene | 25 parts |
| (Coated to a coverage of 1 g/m$^2$). | |

Results of Estimation

The cards obtained as aforesaid were estimated. The results are reported in Table 3.

TABLE 3

| What was Estimated | Example C1 | Example C2 | Comp. Examples C1 | Comp. Examples C2 |
|---|---|---|---|---|
| Resistance to plasticizers | | | | |
| Vinyl chloride card at 40° C., 90% RH and 200 gf/cm$^2$ for 10 days | good | good | bad | bad |
| Eraser at 60° C. and 500 gf/cm$^2$ for 30 min. | good | good | bad | bad |
| Chemical resistance (Dipping Test) | | | | |
| Gasoline 2 min. | good | good | bad | good |
| Trichloroethane 2 min. | good | good | Decoloration | Decoloration |
| Kerosene 2 min. | good | good | Decoloration | Slight decoloration |
| 5% saline 24 hrs. | good | good | bad | good |
| 1% aqueous solution of sodium carbonate 24 hrs. | good | good | Discoloration | good |
| 5% aqueous solution of acetic acid 24 hrs. | good | good | Discoloration | good |
| Chemical resistance (wiping test; intensively wiped 20 times with gauze) | | | | |
| Gasoline | good | good | Decoloration | Slight decoloration |
| Trichloroethane | good | good | Decoloration | Decoloration |
| Kerosene | good | good | Decoloration | Slight decoloration |
| Rub resistance (intensively rubbed 1,000 times with gauze) | | | | |
| | good | good | bad | good |
| Scratch resistance (by nails) | | | | |
| | good | good | bad | good |
| Transferability of resin layer | | | | |
| Adhesion (Cellophane peeling test) | good | good | — | bad |
| Foil cutting | good | good | — | bad |

REFERENCE EXAMPLE D1

Three ink compositions containing sublimable dyes of different colors were prepared with the components mentioned just below.

| Yellow Ink | |
|---|---|
| Disperse dye (Macrolex Yellow 6G made by Bayer Co., Ltd.) | 5.5 parts |
| Polyvinyl butyral resin (Eslec BX-1 made by Sekisui Chemical Co., Ltd.) | 4.5 parts |
| Methyl ethyl ketone/toluene (at a weight ratio of 1:1) | 89.5 parts |

Magenta Ink

This ink was similar to the yellow ink with the exception that a magenta disperse dye (Disperse Red 60) was used.

Cyan Ink

This ink was similar to the yellow ink, provided that a cyan disperse dye (Solvent Blue 63) was used. Provided as a substrate film was a 6.0-μm thick polyester film (Lumirror made by Toray Industries, Ltd.) having on its back surface a heat-resistant slip layer (of 1 μm in thickness) and on its front surface a primer layer (of 0.5 μm in thickness) comprising a polyurethane base resin. Using gravure coating, the aforesaid ink compositions were successively and repeatedly coated on the front surface of the substrate film in the order of yellow, magenta and cyan, at a width of 15 cm and to a coverage of about 3 g/m$^2$. Subsequent drying gave a sublimation type of heat transfer sheet containing sublimable dye layers of three different colors.

REFERENCE EXAMPLE D2

The following wax ink composition, heated at a temperature of 100° C., was coated on the same substrate film as used in Reference Ex. D1 but including no primer layer, to a coverage of about 4 g/m$^2$ by hot melt roll coating, thereby preparing a wax type of heat transfer sheet.

| Wax Ink | |
|---|---|
| Acrylic/vinyl chloride/vinyl acetate copolymer resin | 20 parts |
| Carbon black | 10 parts |
| Toluene | 35 parts |
| Methyl ethyl ketone | 35 parts |

EXAMPLE D1

Using gravure coating, the following ink composition was coated on the same substrate film as used in Reference Ex. D2 at a ratio of 1 g/m$^2$ on dry solid basis. Subsequent drying gave a transparent resin layer.

| Ink for Transparent Resin Layer | |
|---|---|
| Acrylic silicone graft resin (XSA-100 made by Toa Gosei K.K.) | 60 parts |

-continued

| Ink for Transparent Resin Layer | |
|---|---|
| Methyl ethyl ketone | 20 parts |
| Toluene | 20 parts |

Then, the following ink was coated on the surface of the aforesaid resin layer at a rate of 0.7 g/m$^2$ on dry solid basis. Subsequent drying gave an adhesive layer. In this manner, a heat transfer cover film according to this invention was obtained.

| Ink for Adhesive Layer | |
|---|---|
| Vinyl chloride/vinyl acetate copolymer (VYLF made by UCC; Tg = 68° C. and polymerization degree = 220) | 30 parts |
| Microsilica | 0.4 parts |
| Methyl ethyl ketone | 35 parts |
| Toluene | 35 parts |

EXAMPLE D2

The procedures of Ex. D1 were followed with the exception that a vinyl chloride/vinyl acetate copolymer (Denka Lac #21ZA made by Denki Kagaku Kogyo K.K.; and with Tg=62° C. and a polymerization degree of 240) was used as the adhesive, thereby obtaining a heat transfer cover film according to this invention.

EXAMPLE D3

The procedures of Ex. D1 were followed with the exception that a vinyl chloride/vinyl acetate copolymer (VYHH made by UCC; and with Tg=72° C. and a polymerization degree of 450) was used as the adhesive, thereby obtaining a heat transfer cover film according to this invention.

Application Examples D1 to D3

The sublimable dye layer of the sublimation type of heat transfer film of Reference Ex. D1 was overlaid on the surface of a card substrate comprising 100 parts of a compound of polyvinyl chloride—having a polymerization degree of 800—containing about 10% of such additives as a stabilizer, 10 parts of a white pigment (titanium oxide) and 0.5 parts of a plasticizer (DOP), and heat energy was then applied thereto with a thermal head connected to electrical signals obtained by the chromatic separation of a photograph of face to form a full-color image thereof. Subsequently, characters and signs were reproduced with the wax type of heat transfer film of Reference Ex. D2. Finally, a transferable protective layer was transferred onto the respective imaged regions with the heat transfer cover film according to each of Examples D1–3 of this invention to obtain a card bearing the photograph of face and the required pieces of information.

Comparative Example D1

A cover film was prepared by following the procedures of Example D1 with the proviso that an acrylic resin (BR-102 made by Mitsubishi Rayon Co., Ltd.; and with Tg=20° C. and a polymerization degree of 5,000) was used as the adhesive. With this cover film, a card was obtained by following the procedures of Application Ex. D1.

Comparative Example D2

A cover film was prepared by following the procedures of Example D1 with the proviso that a vinyl chloride/vinyl acetate copolymer (VAGH made by UCC; and with Tg=79° C. and a polymerization degree of 450) was used as the adhesive. With this cover film, a card was obtained by following the procedures of Application Ex. D1.

Comparative Example D3

A cover film was prepared by following the procedures of Example D1 with the proviso that a vinyl chloride/vinyl acetate copolymer (VYNS made by UCC; and with Tg=79° C. and a polymerization degree of 700) was used as the adhesive. With this cover film, a card was obtained by following the procedures of Application Ex. D1.

Results of Estimation

The cards obtained as aforesaid were estimated. The results are reported in Table 4.

TABLE 4

| | Example | | | Comp. Examples | | |
|---|---|---|---|---|---|---|
| What was Estimated | D1 | D2 | D3 | D1 | D2 | D3 |
| Resistance to plasticizers | | | | | | |
| Vinyl chloride card at 40° C., 90% RH and 200 gf/cm$^2$ for 10 days | ○ | ○ | ○ | X | ○ | ○ |
| Eraser at 60° C. and 500 gf/cm$^2$ for 30 min. | ○ | ○ | ○ | X | ○ | ○ |
| Adhesion, Foil cutting | | | | | | |
| Adhesion (Cellophane peeling test) | ○ | ○ | Δ | Δ | X | X |
| Foil cutting | ○ | ○ | Δ | ○ | X | X |
| Chemical resistance (Dipping Test) | | | | | | |
| Gasoline 2 min. | ○ | ○ | ○ | ○ | ○ | ○ |
| Scratch resistance (by nails) | | | | | | |
| | ○ | ○ | ○ | ○ | ○ | ○ |

According to the present invention as aforesaid, wherein the heat-sensitive adhesive layer formed on the surface of the transparent resin layer is made of a resin whose Tg lies in the range of 40° to 75° C., the transparent resin layer can be well transferred on an image, while it can be well cut, by means of a thermal head. Thus, since the transparent resin layer is easily transferable onto the image by the heat of the thermal head, it is possible to provide expeditious production of an image representation improved in terms of such properties as durability, esp. rub resistance, chemical resistance and solvent resistance.

EXAMPLE E1

| | |
|---|---|
| Polyvinyl butyral resin (Eslec BX-1 made by Sekisui Chemical Co., Ltd.) | 5.0 parts |
| Disperse dye (PTY-52 made by Mitsubishi Chemical Industries, Ltd.) | 2.0 parts |
| Silicone-modified acrylic resin (XS-315 made by Toa Gosei K.K.) | 0.2 parts |
| Methyl ethyl ketone/toluene (at a weight ratio of 1:1) | 60.0 parts |

By gravure coating, the aforesaid coating solution was coated on one surface of a 6.0-μm thick polyester film having a heat-resistant slip layer on the other surface (S-PET made by Toyobo Co., Ltd.) to a coverage of about 3 g/m$^2$ on dry solid basis. Subsequent drying gave a heat transfer sheet.

| | |
|---|---|
| Vinyl chloride/vinyl acetate copolymer (Denka 1000A made by Denki Kagaku Kogyo K.K.) | 20.0 parts |

-continued

| | |
|---|---|
| Dimethylsiloxane (KF-96 made by The Shin-Etsu Chemical Co., Ltd.) | 0.2 parts |
| Methyl ethyl ketone/toluene (at a weight ratio of 1:1) | 80.0 parts |

With a Miya bar #20, the aforesaid coating solution was coated on the surface of a white polyethylene terephthalate film (PETE-20 made by Toray Industries, Inc.; and with a thickness of 188 μm) at a rate of 5 g/m$^2$on dry solid basis. Subsequent drying gave a heat transfer sheet.

Nought decimal five (0.5) g/m$^2$ of a release layer (an acrylic resin TP-64 Varnish made by DIC K.K.), 3.0 g/m$^2$ of a transparent protective layer (an acrylic resin BR-53 made by Mitsubishi Rayon Co., Ltd. and 0.5 g/m$^2$ of a heat-sensitive adhesive layer (a vinyl chloride/vinyl acetate copolymer Denka 1000A made by Denki Kagaku Kogyo K.K.) were successively coated on the surface of a polyethylene terephthalate film (S-PET made by Toyobo Co., Ltd.; and with a thickness of 9 μm). Subsequent drying gave a heat transfer cover film.

The heat transfer sheet was overlaid on the heat transfer image-receiving sheet while the former's dye layer was in opposition to the latter's dye-receiving layer. With a thermal sublimation type of transfer printer (VY50 made by Hitachi, Ltd.), a printing energy of 90 mJ/mm$^2$ was then applied to the back side of the heat transfer sheet through the thermal head to make an image. Finally, the transparent protective. film was transferred from the heat transfer cover film onto the image under similar conditions. In consequence, the transparent protective layer could be easily transferred onto the image. They remained so well bonded to each other that they could hardly be separated from each other.

EXAMPLE E2

The transfer of the transparent protective layer was performed with a laminators made by Meiko Shokai K.K. As a result, that layer could be easily transferred onto the image. They remained so well bonded to each other that they could hardly be separated from each other.

EXAMPLE E3

Experimentation was carried out by following the procedures of Example E1 with the proviso that the dye layer was made from the following coating solution. As a result, the transparent protective layer could be easily transferred onto the image. They remained so well bonded to each other that they could hardly be separated from each other.

| | |
|---|---|
| Polyvinyl butyral resin (Eslec BX-1 made by Sekisui Chemical Co., Ltd.) | 5.0 parts |
| Disperse dye (KST-B-136 made by Nippon Kayaku K.K.) | 0.5 part |
| Fluorine-modified silicone (FL100 made by The Shin-Etsu Chemical Co., Ltd.) | 0.2 parts |
| Methyl ethyl ketone/toluene (at a weight ratio of 1:1) | 60.0 parts |

EXAMPLE E4

The procedures of Ex. E1 were followed with the exception that the dye-receiving layer was made from the following coating solution. In consequence, the transparent protective layer could be easily transferred onto the image. They remained so well bonded to each that they could hardly be separated from each other.

| | |
|---|---|
| Polyester resin (Vylon 600 made by Toyobo Co., Ltd.) | 20.0 parts |
| Epoxy-modified silicone (KF-393 made by The Shin-Etsu Chemical Co., Ltd.) | 0.5 parts |
| Methyl ethyl ketone/toluene (at a weight ratio of 1:1) | 80.0 parts |

Comparative Example E1

The procedures of Ex. E1 were followed, but the dye layer was made from a coating solution comprising:

| | |
|---|---|
| Polyvinyl butyral resin (Eslec BX-1 made by Sekisui Chemical Co., Ltd.) | 5.0 parts |
| Disperse dye (PTY-52 made by Mitsubishi Chemical Industries, Ltd.) | 2.0 parts |
| Methyl ethyl ketone/toluene (at a weight ratio of 1:1) | 60.0 parts, |

and the dye-receiving layer was made from a coating solution comprising:

| | |
|---|---|
| Vinyl chloride/vinyl acetate copolymer resin (Denka 1000A made by Denki Kagaku Kogyo K.K.) | 20.0 parts |
| Epoxy-modified silicone (KF-393 made by The Shin-Etsu Chemical Co., Ltd.) | 2.0 parts |
| Amino-modified silicone (KF-343 made by The Shin-Etsu Chemical Co., Ltd.) | 2.0 parts |
| Methyl ethyl ketone/toluene (at a weight ratio of 1:1) | 80.0 parts. |

However, the transfer of the transparent protective layer was almost unfeasible. That layer, if somehow transferred onto the image, could be immediately peeled off it, thus failing to produce sufficient adhesion to it.

Comparative Example E2

In Comparative Example E2, the transfer of the transparent protective layer was performed with a hot roll. However, it was almost unfeasible. That layer, if somehow transferred onto the image, could be immediately peeled off it, thus failing to produce sufficient adhesion to it.

EXAMPLE F1

Provided as a substrate film was a 6-μm thick polyethylene terephthalate film having a 0.1-μm thick, easily bondable layer on one surface and a heat-resistant slip layer on the other surface. A toluene solution of an acrylic resin comprising 10 parts of TR-64 Varnish (made by Dainippon Ink & Chemicals, Inc.) and 40 parts of toluene was coated on said one surface of the polyethylene terephthalate film, while leaving three regions of A4 size, to a dry thickness of 0.7 μm, followed by drying which resulted in a releasable protective layer being formed on such regions.

Subsequently, a black ink comprising 10 parts of MSF (made by Toyo Ink Mfg. Co., Ltd.) and 40 parts of toluene was coated on the surface of that layer to a dry thickness of 2 μm, followed by drying which gave a heat-meltable ink layer. Further, a toluene solution of an acrylic resin comprising 10 parts of TR-64 varnish (made by Dainippon Ink & Chemicals, Inc.) and 40 parts of toluene was coated on the surface of that ink layer to a dry thickness of 0.5 μm, followed by drying which gave a heat-sensitive adhesive layer.

Moreover, three ink compositions of different colors forming the dye layer were successively gravure printed between the aforesaid ink layers to a dry thickness of 1.0 g/m$^2$ in the order of yellow, magenta and cyan. Subsequently drying gave a heat transfer sheet of this invention in the form of a continuous film.

| Yellow Ink | |
|---|---|
| PTY-52 (C.I. Disperse Yellow 141 made by Mitsubishi Chemical Industries, Ltd.) | 5.50 parts |
| Polyvinyl butyral resin (Eslec BX-1 made by Sekisui Chemical Co., Ltd.) | 4.80 parts |
| Methyl ethyl ketone | 55.00 parts |
| Toluene | 34.70 parts |
| Releasant | 1.03 parts |
| Magenta Ink | |
| MS Red G (C.I. Disperse Red 60 made by Mitsui Toatsu Chemicals, Inc.) | 2.60 parts |
| Macrolex Red Violet R (C.I. Disperse Violet 26 made by Bayer Co., Ltd.) | 1.40 parts |
| Polyvinyl butyral resin (Eslec BX-1) | 3.92 parts |
| Methyl ethyl ketone | 43.34 parts |
| Toluene | 43.34 parts |
| Releasant | 0.40 parts |
| Cyan Ink | |
| Kayaset Blue 714 (C.I. Solvent Blue 63 made by Nippon Kayaku K.K.) | 5.50 parts |
| Polyvinyl butyral resin (Eslec BX-1) | 3.92 parts |
| Methyl ethyl ketone | 22.54 parts |
| Toluene | 68.18 parts |
| Releasant | 0.94 parts |

EXAMPLE F2

A heat transfer sheet was obtained by following the procedures of Example E1 with the exception that the releasable protective layer having a dry thickness of 0.5 μm was made from an acrylic/vinylic resin solution comprising 10 parts of MCS-5065 (made by Dainippon Ink & Chemicals, Inc.) and 40 parts of toluene.

Example F3

A heat transfer sheet was obtained by following the procedures of Example E1 with the exception that the releasable protective layer having a dry thickness of 0.5 μm was made from a chlorinated polyolefinic resin solution comprising 10 parts of TR-15 varnish (made by Dainippon Ink & Chemicals, Inc.) and 40 parts of toluene.

EXAMPLE F4

A heat transfer sheet according to this invention was obtained by following the procedures of Example E1 with the exception that the substrate film used was a polyethylene naphthalate film (6 μm in thickness) including an easily bondable layer (of 0.2 μm in thickness) made of a heat-curable epoxy resin.

Comparative Example F13

A heat transfer sheet according to this invention was obtained by following the procedures of Example E1 with the proviso that the substrate film used was the same polyethylene terephthalate film as used therein, but including no easily bondable layer.

Comparative Example F2

A heat transfer sheet according to this invention was obtained by following the procedures of Example E4 with the proviso that the substrate film used was the same polyethylene terephthalate film as used therein, but including no easily bondable layer.

Application Example E

With the following components, a white card substrate core (of 0.2 μm in thickness and 30×30 cm in size) was prepared.

| | |
|---|---|
| Compound of polyvinyl chloride having a polymerization degree of 800 and containing about 10% of such additives as a stabilizer | 100 parts |
| White pigment (titanium oxide) | 15 parts |

Then, transparent sheets of 0.15 mm in thickness) were formed of the following components, and were in turn thermally pressed onto both sides of the aforesaid white core to prepare a card substrate.

| | |
|---|---|
| Compound of polyvinyl chloride having a polymerization degree of 800 and containing about 10% of such additives as a stabilizer | 100 parts |
| Plasticizer (DOP) | 3 parts |
| Slip agent (amide stearate) | 0.5 parts |

Each of the heat transfer sheets according to this invention and for comparative purposes was overlaid on the surface of the aforesaid card substrate, and heat energy was in turn applied thereto through a thermal head connected to electrical signals of the cyan component obtained by the chromatic separation of a photograph of face. Then, the sublimation transfer of magenta and yellow images was carried out to make a full-color image thereof. Moreover, such pieces of information as name and address and bar codes were formed with a wax type of ink layer. Finally, examination was made of whether the unusual transfer of the sublimable dye layers took place and the resolution of the resulting images. The results are set out in Table 5.

TABLE 5

| Heat Transfer Sheets | Unusual Transfer | Resolution |
|---|---|---|
| Example | | |
| F1 | Not found | Good |
| F2 | Not found | Good |
| F3 | Not found | Good |
| F4 | Not found | Good |
| Comp. Ex. | | |
| F1 | found | Bad |
| F2 | found | Bad |

EXAMPLE G1

A heat transfer cover sheet was prepared by following the procedures of Example A1 with the proviso that the following water soluble polymer composition was used as the ink for the release layer.

| Ink for Release Layer | |
|---|---|
| Polyvinyl alcohol AH-26 (made by Nippon Gosei Kagaku K.K.) | 2.0 parts |
| Ethyl alcohol | 49.0 parts |
| Pure water | 49.9 parts |

EXAMPLE G2

A heat transfer cover sheet was prepared by following the procedures of Example A1 with the proviso that the following water soluble polymer composition was used as the ink for the release layer.

| Ink for Release Layer | |
|---|---|
| Polyvinyl alcohol C-500 (made by Nippon Gosei Kagaku K.K.) | 2.0 parts |
| Ethyl alcohol | 49.0 parts |
| Pure water | 49.9 parts |

EXAMPLE G3

A heat transfer cover sheet was prepared by following the procedures of Example A1 with the proviso that the following water soluble polymer composition was used as the ink for the release layer.

| Ink for Release Layer | |
|---|---|
| Polyvinyl alcohol KL-05 (made by Nippon Gosei Kagaku K.K.) | 2.0 parts |
| Polyvinyl alcohol L-5407 (made by Nippon Gosei Kagaku K.K.) | 1.8 parts |
| Ethyl alcohol | 49.0 parts |
| Pure water | 49.9 parts |

INDUSTRIAL APPLICABILITY

The present invention may find wide applications in preparing objects on which prints or images are formed by heat transfer techniques, for instance, ID cards.

We claim:

1. A heat transfer cover film comprising:

a substrate film;

a transparent resin layer releasably provided on the substrate film, said transparent resin layer comprising at least one material selected from the group consisting of a wax, a slip agent, an ultraviolet absorber, an antioxidant and a fluorescent brightener;

a release layer interleaved between said substrate film and said transparent resin layer, said release layer comprising a water soluble polymer selected from the group consisting of polyvinyl alcohol, polyvinyl pyrrolidone, gelatin, carboxymethylcellulose, methylcellulose, polyethylene oxide, gum arabic, water soluble butyral, water soluble polyester, water soluble polyurethane, water soluble polyacrylic, water soluble polyamide, and mixtures thereof;

a heat-sensitive adhesive layer provided on said transparent resin layer, said heat-sensitive adhesive layer comprising a resin having a mean polymerization degree of 50–300 and a glass transition temperature lying in the range of 40° to 75° C., said resin being selected from the group consisting of polyvinyl chloride, polyvinyl acetate, a vinyl chloride/vinyl acetate copolymer and mixtures thereof; and a dye layer provided on said substrate film.

* * * * *